US011208222B2

(12) United States Patent
Shimoda et al.

(10) Patent No.: US 11,208,222 B2
(45) Date of Patent: Dec. 28, 2021

(54) BAG-MAKING AND PACKAGING MACHINE

(71) Applicant: ISHIDA CO., LTD., Kyoto (JP)

(72) Inventors: Takafumi Shimoda, Ritto (JP); Masaki Shinkawa, Ritto (JP); Ryota Nagashima, Ritto (JP); Satoshi Hashimoto, Ritto (JP); Makoto Ichikawa, Ritto (JP); Yuchuan Tong, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 221 days.

(21) Appl. No.: 16/591,621

(22) Filed: Oct. 3, 2019

(65) Prior Publication Data

US 2020/0108959 A1 Apr. 9, 2020

(30) Foreign Application Priority Data

Oct. 4, 2018 (JP) ..... JP2018-189570

(51) Int. Cl.
*B65B 9/20* (2012.01)
*B65B 43/08* (2006.01)
(Continued)

(52) U.S. Cl.
CPC ..... *B65B 9/20* (2013.01); *B65B 9/10* (2013.01); *B65B 41/16* (2013.01); *B65B 43/08* (2013.01);
(Continued)

(58) Field of Classification Search
CPC ..... B65H 19/1868; B65H 19/1873; B65H 19/18; B65H 2301/4631;
(Continued)

(56) References Cited

U.S. PATENT DOCUMENTS 3,022,022 A * 2/1962 Freeman ..... B65H 19/1852 242/422.9
3,825,201 A * 7/1974 Osta ..... B65H 19/1868 242/554.3
(Continued)

FOREIGN PATENT DOCUMENTS

CN 108116919 A 6/2018
EP 1950137 A1 7/2008
(Continued)

OTHER PUBLICATIONS

The Examination Report from the corresponding Australian Patent Application No. 2019240652 dated Jun. 12, 2020.
(Continued)

*Primary Examiner* — Gregory W Adams
(74) *Attorney, Agent, or Firm* — Shinjyu Global IP

(57) ABSTRACT

A bag-making and packaging machine has a film supply unit that supplies film to a bag-making and packaging unit. The film supply unit has holding mechanisms each having a shaft that holds a film roll, a holding mechanism support frame supporting the holding mechanisms, a moving mechanism that rotates the holding mechanism support frame to move each holding mechanism between a film roll setting position and a film supply position, a splicing mechanism splicing a trailing end portion of the film of the roll of one of the holding mechanisms and a leading end portion of the film of the roll of another one of the holding mechanisms, and a film drawing mechanism that rotates the shafts of the holding mechanisms to draw the film independently from the film rolls attached to the shafts of the holding mechanisms and changes the drawing speed of the film during bag-making and packaging.

5 Claims, 11 Drawing Sheets

(51) Int. Cl.

| | |
|---|---|
| ***B65B 9/10*** | (2006.01) |
| ***B65B 41/16*** | (2006.01) |
| ***B65H 16/02*** | (2006.01) |
| ***B65H 16/10*** | (2006.01) |

(52) U.S. Cl.
CPC ..... *B65H 16/024* (2020.08); *B65H 16/103* (2013.01)

(58) Field of Classification Search
CPC ..... A01F 2015/0725; B31B 70/006; B65B 41/12; B65B 57/04; B65B 43/08; B65B 9/10; B65B 41/16
See application file for complete search history.

(56) References Cited

U.S. PATENT DOCUMENTS

| | | | | | |
|---|---|---|---|---|---|
| 3,907,235 | A * | 9/1975 | Gaubert | B65H 19/1831 | 242/554 |
| 5,114,088 | A * | 5/1992 | Cardano | B65H 16/06 | 242/129.6 |
| 6,096,150 | A * | 8/2000 | Ohno | B65H 19/1821 | 156/157 |
| 6,792,987 | B2 * | 9/2004 | Monroe | B65H 19/1852 | 156/351 |
| 7,431,234 | B2 * | 10/2008 | Ballestrazzi | B65B 41/12 | 242/552 |
| 7,644,559 | B2 * | 1/2010 | Smith | A01F 15/0715 | 53/430 |
| 2012/0234469 | A1 * | 9/2012 | Okabe | B65H 19/1852 | 156/157 |
| 2014/0274629 | A1 * | 9/2014 | Lykowski | B65B 9/20 | 493/17 |

FOREIGN PATENT DOCUMENTS

| | | | |
|---|---|---|---|
| JP | S55-3489 | U | 1/1980 |
| JP | S55-5384 | A | 1/1980 |
| JP | S61-83654 | U | 6/1986 |
| JP | H4-89747 | A | 3/1992 |
| JP | H4-197954 | A | 7/1992 |
| JP | H4-223957 | A | 8/1992 |
| JP | H8-91306 | A | 4/1996 |
| JP | H8-208083 | A | 8/1996 |
| JP | H10-129631 | A | 5/1998 |
| JP | 2002-179301 | A | 6/2002 |
| JP | 2002-308485 | A | 10/2002 |
| JP | 2003-040220 | A | 2/2003 |
| JP | 2007-161377 | A | 6/2007 |
| JP | 2008-127091 | A | 6/2008 |
| JP | 2012-006691 | A | 1/2012 |
| JP | 2012-136343 | A | 7/2012 |
| JP | 2014-094831 | A | 5/2014 |
| WO | 2008/087711 | A1 | 7/2008 |

OTHER PUBLICATIONS

The Search Report from the corresponding European Patent Application No. 19201302.7 dated Feb. 25, 2020.

The Information Statement (Submission of Publications) filed in the corresponding Japanese Patent Application No. 2018-189570 dated Jul. 29, 2020.

The Office Action from the corresponding Chinese Patent Application No. 201910939852.X dated Sep. 10, 2021.

* cited by examiner

BAG-MAKING AND PACKAGING MACHINE

CROSS-REFERENCE TO RELATED APPLICATIONS

This application claims priority to Japanese Patent Application No. 2018-189570, filed Oct. 4, 2018. The contents of that application are incorporated by reference herein in their entirety.

TECHNICAL FIELD

The present invention relates to a bag-making and packaging machine, and particularly a bag-making and packaging machine that produces bags filled with contents by forming a sheet-like film drawn from a film supply unit into bags with a bag-making and packaging unit.

BACKGROUND ART

Conventionally, a bag-making and packaging machine is known which produces bags filled with contents by forming a sheet-like film drawn from a film supply unit into bags with a bag-making and packaging unit. There are cases where, as in JP-A No. 2008-127091, this kind of bag-making and packaging machine uses a film supply unit that holds plural film rolls into which film for packaging is wound and, when the film supply unit uses up the film of a film roll which has been used, automatically splices together the trailing end portion of that film and the leading end portion of the film of a new film roll for replacement and starts supplying the film of the new film roll to the bag-making and packaging unit. By utilizing this kind of film supply unit, it is not necessary for the operator to manually set the film roll at the timing when the film supply unit uses up a film roll, and there can be realized a bag-making and packaging machine that is efficient and in which the amount of time the machine is stopped to replace the film roll is short.

BRIEF SUMMARY

However, the bag-making and packaging machine of JP-A No. 2008-127091 has the problem that the workload of the operator tends to increase because the position where the operator sets the film roll differs per shaft rotatably holding the film roll.

It is an object of the present invention to provide a bag-making and packaging machine in which the workload of the operator is small.

A bag-making and packaging machine pertaining to a first aspect of the invention has a bag-making and packaging unit and a film supply unit. The bag-making and packaging unit forms a sheet-like film into a tubular shape and seals the film formed into the tubular shape to thereby form the film into bags. The film supply unit holds a film roll into which the sheet-like film is wound and supplies to the bag-making and packaging unit the film that is drawn from the film roll. The film supply unit has plural film roll holding mechanisms, a frame, a frame shaft, a moving mechanism, a splicing mechanism, and a film drawing mechanism. Each of the plural roll holding mechanisms includes a shaft to which the film roll is attached and which rotatably holds the attached film roll. The frame supports the plural film roll holding mechanisms. The frame shaft rotatably supports the frame. The moving mechanism rotates the frame to thereby move the film roll holding mechanisms between at least a first position and a second position that is different from the first position. In the first position, the film roll is attached to the shaft. In the second position, the film is drawn from the film roll attached to the shaft to the bag-making and packaging unit. The splicing mechanism splices together a trailing end portion of the film wound into the film roll attached to the shaft of one of the film roll holding mechanisms and a leading end portion of the film wound into the film roll attached to the shaft of another one of the film roll holding mechanisms. The film drawing mechanism respectively independently rotates the shafts of the plural film roll holding mechanisms to thereby draw the film from the film rolls attached to the shafts of the plural film roll holding mechanisms. The film drawing mechanism changes the drawing speed of the film at the time of bag-making and packaging actions in the bag-making and packaging unit.

In the bag-making and packaging machine pertaining to the first aspect of the invention, the film rolls are attached to the shafts in the same position (the first position) and are moved by the moving mechanism to other positions. For that reason, the workload of the operator of the bag-making and packaging machine can be reduced.

Furthermore, here, the drawing speed of the film rolls at the time of the bag-making and packaging actions can be changed, so an efficient bag-making and packaging machine can be realized.

A bag-making and packaging machine pertaining to a second aspect of the present invention is the bag-making and packaging machine of the first aspect, wherein the frame shaft includes a multilayer shaft structure. The moving mechanism includes a first motor and a first transmission mechanism. The first motor rotates the frame. The first transmission mechanism transmits the driving force of the first motor to a first layer shaft of the frame shaft. The film drawing mechanism includes a second motor, a second transmission mechanism, and a third transmission mechanism. The second motor rotates the shaft of one of the film roll holding mechanisms among the plural film roll holding mechanisms. The second transmission mechanism transmits the driving force of the second motor to a second layer shaft of the frame shaft. The third transmission mechanism transmits the driving force transmitted to the second layer shaft of the frame shaft to the shaft of the film roll holding mechanism that is the drive target of the second motor.

In the bag-making and packaging machine pertaining to the second aspect of the present invention, a multilayer shaft structure is employed for the frame shaft whose position is not changed by the rotation of the frame, and the driving force of the motor is transmitted to the shaft via the frame shaft. For that reason, the second motor that drives the shaft does not need to be moved when the film roll holding mechanisms are moved. For that reason, attachment of the film rolls in the same position can be realized with a simple structure.

A bag-making and packaging machine pertaining to a third aspect of the present invention is the bag-making and packaging machine of the first aspect or the second aspect, wherein the film supply unit further has a movable roller that is disposed on a conveyance path of the film drawn from the film roll and causes tension to act on the film. The film drawing mechanism changes the drawing speed of the film on the basis of the position of the movable roller at the time of the bag-making and packaging actions in the bag-making and packaging unit.

In the bag-making and packaging machine pertaining to the third aspect of the present invention, the drawing speed of the film is adjusted based on the position of the movable roller, so high-speed bag-making can be realized.

A bag-making and packaging machine pertaining to a fourth aspect of the present invention is the bag-making and packaging machine of any of the first aspect to the third aspect, wherein the bag-making and packaging unit has a film conveyance mechanism that conveys the film. The film drawing mechanism changes the drawing speed of the film on the basis of the speed at which the film is conveyed by the film conveyance mechanism at the time of the bag-making and packaging actions in the bag-making and packaging unit.

In the bag-making and packaging machine pertaining to the fourth aspect of the present invention, the speed at which the film is drawn from the film rolls is adjusted in accordance with the speed at which the film is conveyed by the film conveyance mechanism in the bag-making and packaging unit, so high-speed bag-making can be realized.

A bag-making and packaging machine pertaining to a fifth aspect of the present invention is the bag-making and packaging machine of any of the first aspect to the fourth aspect, wherein before the leading end portion of the film of the film roll attached to the shaft of a first one of the film roll holding mechanisms is connected by the splicing mechanism to the trailing end portion of the film of the film roll attached to the shaft of a second one of the film roll holding mechanisms, the moving mechanism moves the first one of the film roll holding mechanisms to a third position rotated by a predetermined angle around the frame shaft from the first position. When the moving mechanism moves the first one of the film roll holding mechanisms from the first position to the third position, the film drawing mechanism rotates the shaft of the first one of the film roll holding mechanisms by an angle according to the predetermined angle in the same direction as the direction in which the moving mechanism rotates the first one of the film roll holding mechanisms.

In the bag-making and packaging machine pertaining to the fifth aspect of the present invention, when the first film roll holding mechanism that holds a replacement film roll is rotated by the predetermined angle from the first position to the third position to splice the film, the shaft of the first film roll holding mechanism is rotated by an angle according to the predetermined angle in the same direction as the direction in which the moving mechanism rotates the first film roll holding mechanism. For that reason, slackness in the film arising because of the rotation of the first film roll holding mechanism can be eliminated so that the occurrence of misalignment of the film and/or conveyance problems caused by the slackness in the film can be reduced.

In the bag-making and packaging machine pertaining to the present invention, the film rolls are attached to the shafts in the same position (the first position) and are moved by the moving mechanism to other positions, so the workload of the operator of the bag-making and packaging machine can be reduced.

Furthermore, in the bag-making and packaging machine pertaining to the present invention, the drawing speed of the film can be changed, so efficient bag-making can be realized.

DETAILED DESCRIPTION

Figure 1:
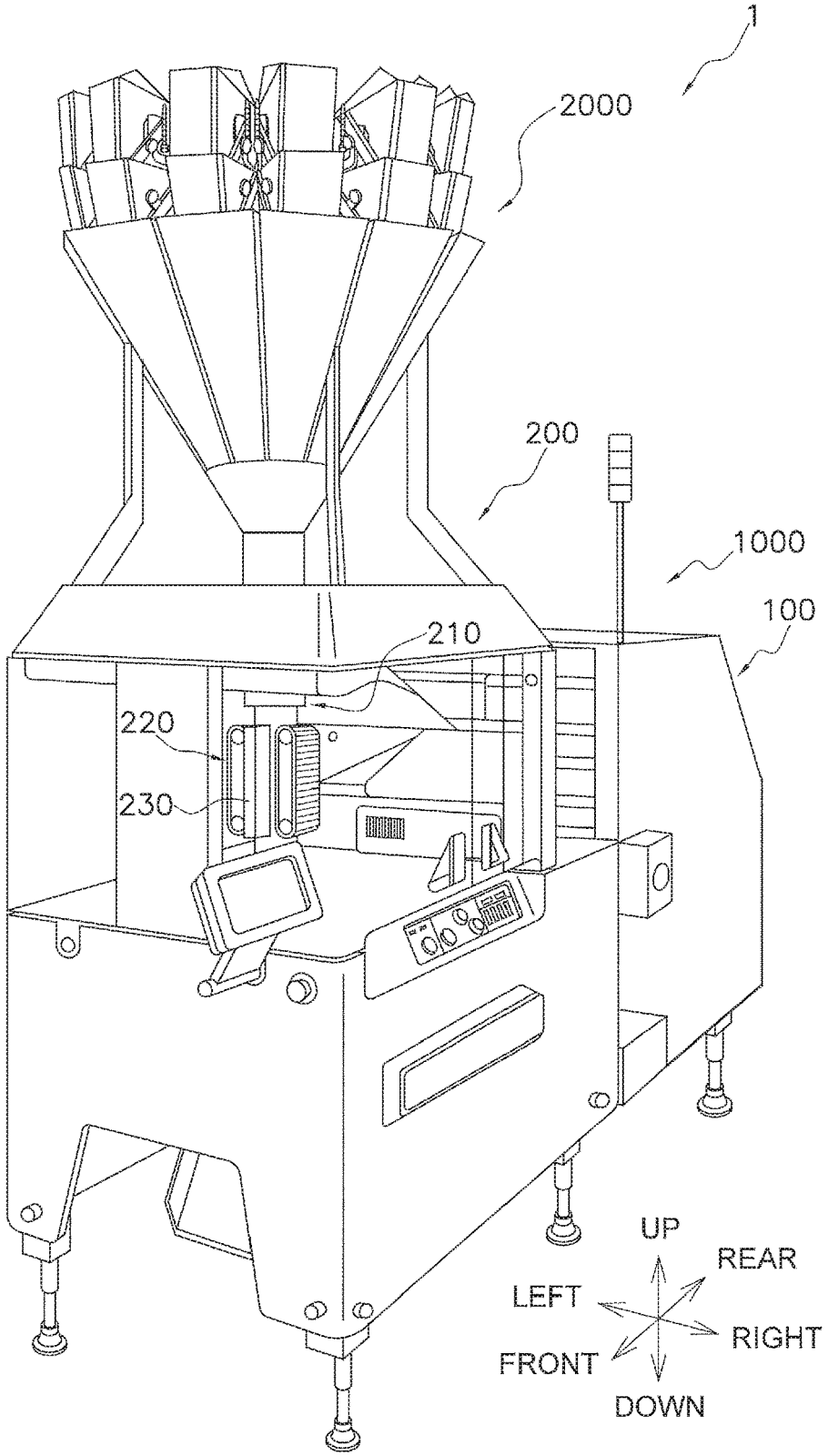
FIG. 1 is a general perspective view of a combination weighing/bag-making and packaging system that includes a bag-making and packaging machine pertaining to an embodiment of the present invention.

A bag-making and packaging machine 1000 of an embodiment of a bag-making and packaging machine pertaining to the invention will now be described with reference to the drawings. The following embodiment is merely a specific example of the invention and is not intended to limit the technical scope of the invention. It will be understood that various changes can be made in configurations and details without departing from the spirit and scope of the invention set forth in the claims.

In the following description there are cases where expressions such as perpendicular, orthogonal, horizontal, and vertical are used to describe directions and positional relationships, but these include not only cases where the directions and positional relationships are strictly perpendicular, orthogonal, horizontal, or vertical but also cases where the directions and positional relationships are substantially perpendicular, orthogonal, horizontal, or vertical.

Furthermore, in the following description there are cases where expressions such as "front (front surface)," "rear (back surface)," "upper," "lower," "left," and "right" are used to describe directions and the like. Unless otherwise specified, "front (front surface)," "rear (back surface)," "upper," "lower," "left," and "right" here follow the directions of the arrows shown in the drawings.

(1) Overall Configuration

Figure 2:
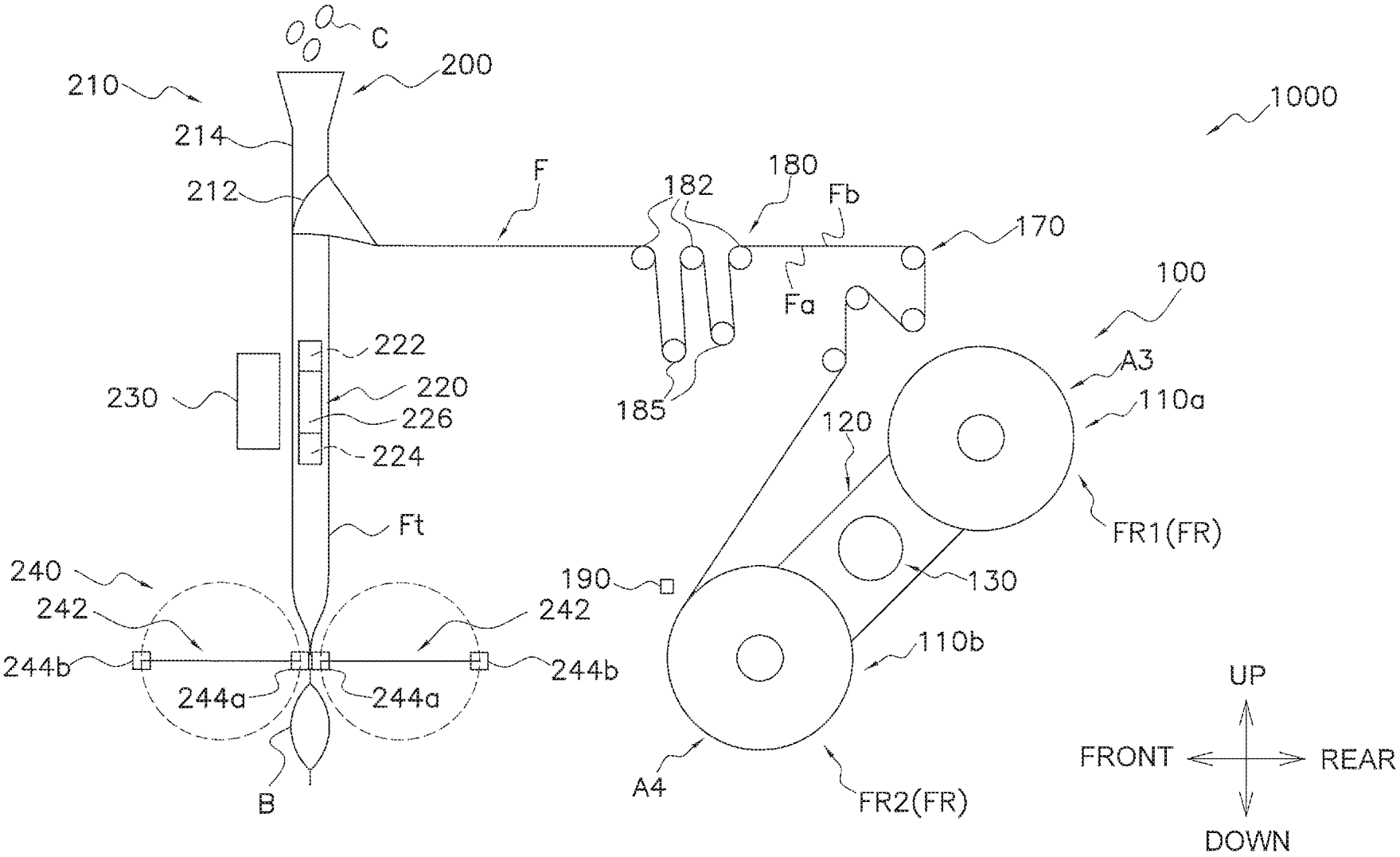
FIG. 2 is a general configuration diagram of the bag-making and packaging machine of the combination weighing/bag-making and packaging system of FIG. 1.
Figure 3:
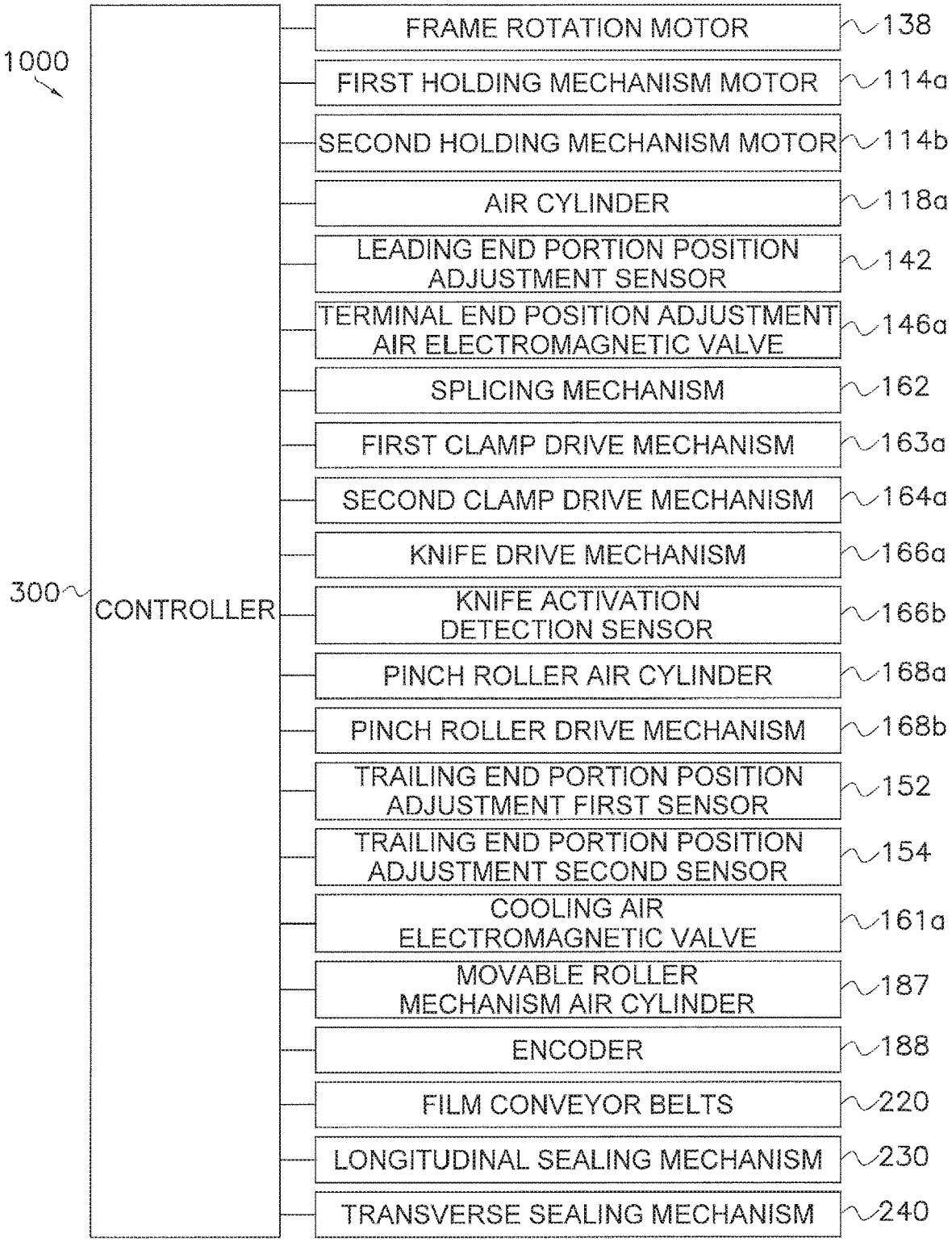
FIG. 3 is a block diagram of the bag-making and packaging machine of FIG. 2.
Figure 4:
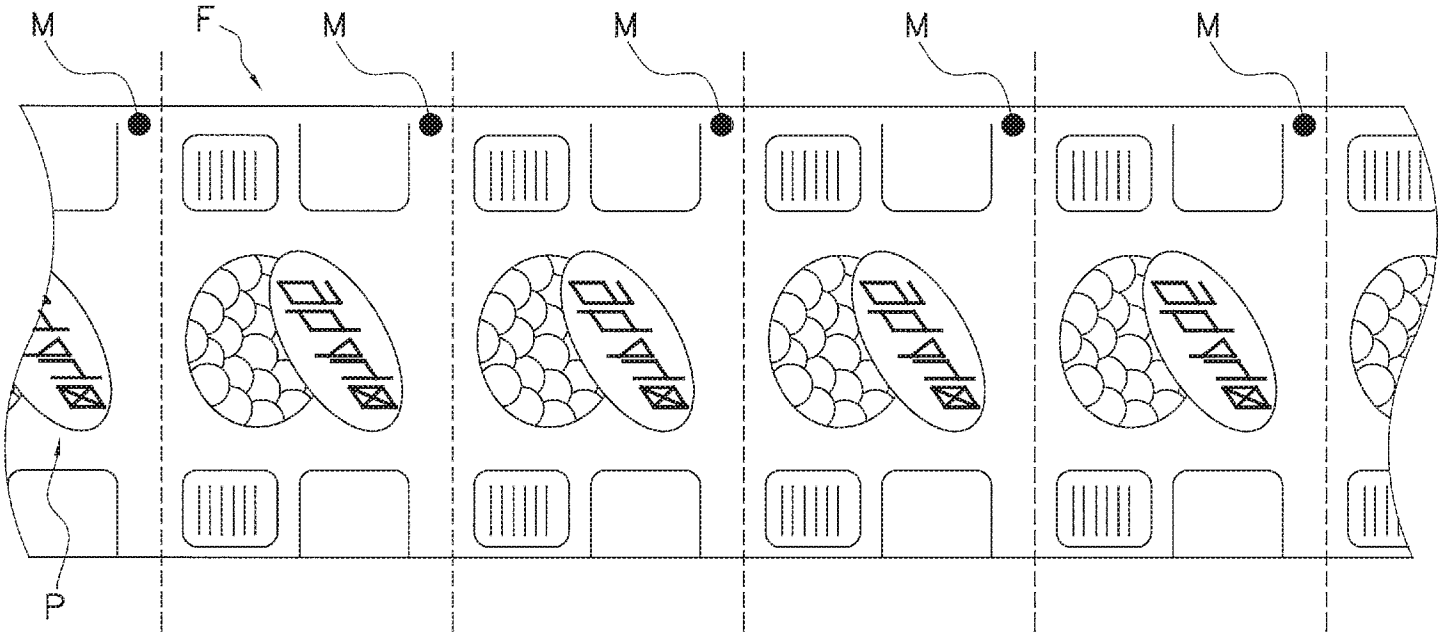
FIG. 4 is a drawing showing an example of film used in the bag-making and packaging machine of FIG. 2.

FIG. 1 is a general perspective view of a combination weighing/bag-making and packaging system 1 that includes the bag-making and packaging machine 1000 pertaining to the embodiment of the invention. FIG. 2 is a general configuration diagram of the bag-making and packaging machine 1000. FIG. 3 is a block diagram of the bag-making and packaging machine 1000. FIG. 4 is a drawing showing an example of film F used in the bag-making and packaging machine 1000.

The combination weighing/bag-making and packaging system 1 includes a combination weighing apparatus 2000 and the bag-making and packaging machine 1000 (see FIG. 1).

The bag-making and packaging machine 1000 is a machine that makes bags B containing articles C inside by making bag-like packages from sheet-like film F (see FIG. 2).

The film F used here includes a printed surface Fa (see FIG. 4), which is disposed on the outer surface side when the film F has been formed into the bags B, and a non-printed surface Fb, which is on the reverse side of the printed surface Fa. The printed surface Fa has printing P on it. The non-printed surface Fb does not have printing on it. The printing P is, for example, characters, illustrations, and photographs that are printed for advertisement and sales promotion of the articles C as a product and providing information relating to the articles C. Also printed on the printed surface Fa, in addition to the printing P, are register marks M that are used to detect the position of the film F.

The articles C are, for example, potato chips. However, the type of the articles C is not limited to potato chips. The articles C are supplied from the combination weighing apparatus 2000 installed above the bag-making and packaging machine 1000 (see FIG. 2).

The bag-making and packaging machine 1000 has a bag-making and packaging unit 200, a film supply unit 100, and a controller 300 (see FIG. 2 and FIG. 3). The controller 300 controls the actions of various constituent devices of the bag-making and packaging unit 200 and the film supply unit 100. The film supply unit 100 holds film rolls FR into which the sheet-like film F is wound and supplies to the bag-making and packaging unit 200 the film F that is drawn from the film rolls FR. The bag-making and packaging unit 200 forms the sheet-like film F into a tubular shape and seals the film Ft that has been formed into the tubular shape to thereby form the film Ft into bags.

Figure 6:
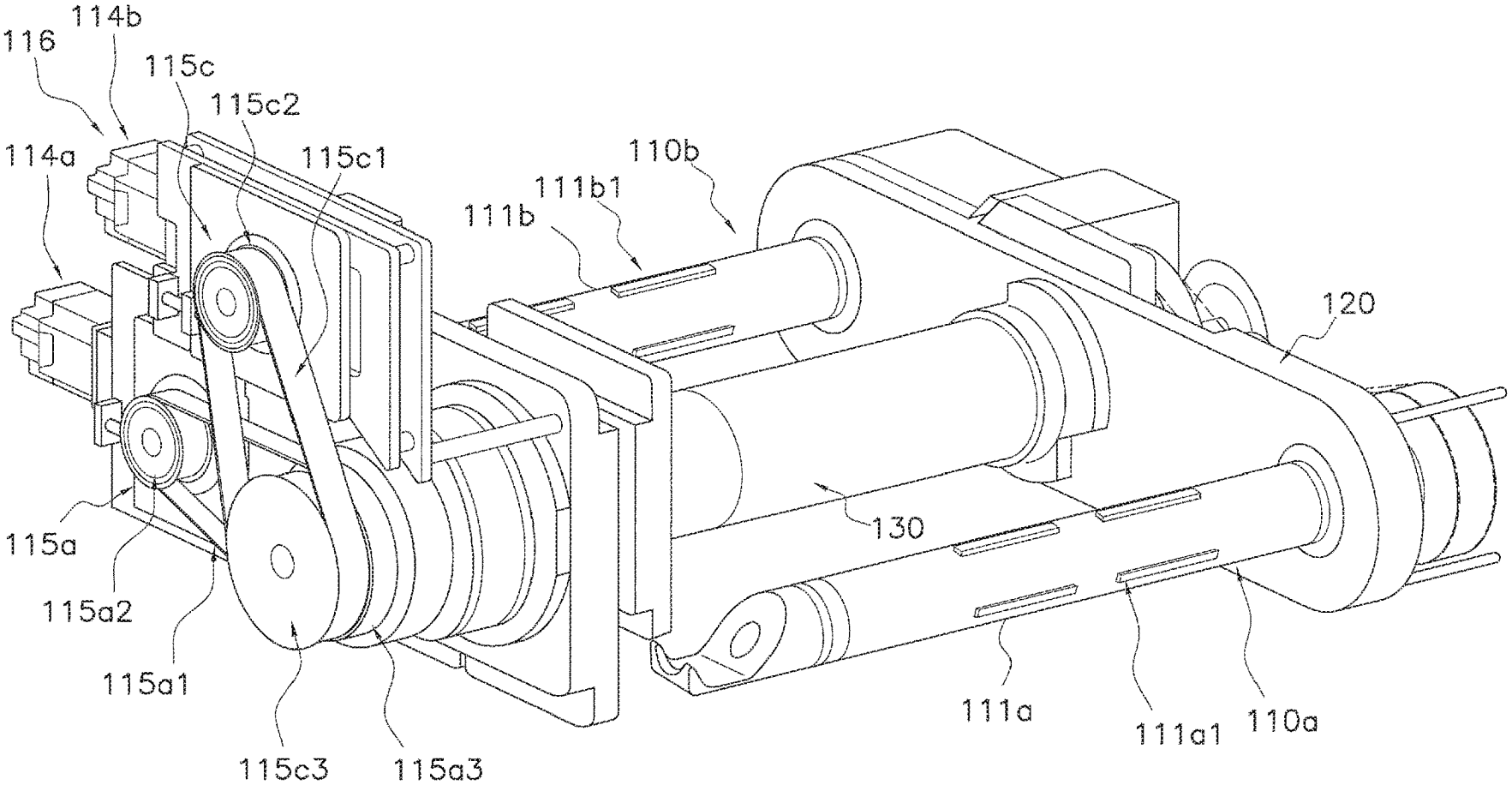
FIG. 6 is an enlarged perspective view around a holding mechanism support frame of the film supply unit of FIG. 5.

The film supply unit 100 mainly has, as mechanisms relating to the supply of the film F, a first holding mechanism 110*a* and a second holding mechanism 110*b*, a film drawing mechanism 116, and a tension adjusting mechanism 180 (see FIG. 2 and FIG. 6). Each of the holding mechanisms 110*a*, 110*b* holds a film roll FR into which the sheet-like film F is wound (see FIG. 2). Specifically, the first holding mechanism 110*a* has a shaft 111*a* to which a film roll FR is attached and which rotatably holds the attached film roll FR (see FIG. 6). The second holding mechanism 110*b* has a shaft 111*b* to which a film roll FR is attached and which rotatably holds the attached film roll FR (see FIG. 6).

The film roll FR is a roll in which the sheet-like film F of FIG. 4 is wound around a winding core (not shown in the drawings). The terminal end on the winding core side of the film F wound into the film roll FR is connected (secured) to the winding core by, for example, affixing it with tape not shown in the drawings to the winding core or adhering it with an adhesive or the like to the winding core.

The film drawing mechanism 116 is a mechanism that respectively independently rotates each of the shafts (the first shaft 111*a* and the second shaft 111*b*) of the plural holding mechanisms (the first holding mechanism 110*a* and the second holding mechanism 110*b*) to thereby draw the film F from the film rolls FR attached to the shafts of the holding mechanisms. The film drawing mechanism 116 has a first holding mechanism motor 114*a* and a second holding mechanism motor 114*b*. The first holding mechanism motor 114*a* is a mechanism that rotates the shaft 111*a* to thereby draw the film from the film roll FR attached to the shaft 111*a*. The second holding mechanism motor 114*b* is a mechanism that rotates the shaft 111*b* to thereby draw the film from the film roll FR attached to the shaft 111*b*. That is, in this bag-making and packaging machine 1000, the film F is not drawn using a single film drawing mechanism (e.g., a pinch roller disposed on the downstream side of the film rolls FR in the conveyance direction of the film F) but the film F is drawn using the respectively independent holding mechanism motors 114*a*, 114*b* from the film rolls FR attached to the shafts 111*a*, 111*b* of the plural holding mechanisms 110*a*, 110*b*.

The bag-making and packaging unit 200 mainly has a former unit 210, which has a former body 212 and a tube 214, film conveyor belts 220, a longitudinal sealing mechanism 230, and a transverse sealing mechanism 240 (see FIG. 2).

The bag-making and packaging machine 1000 manufactures the bags B containing the articles C with a process as shown in the following flow as a result of the actions of the various constituent devices of the bag-making and packaging unit 200 and the film supply unit 100 being controlled by the controller 300 (see FIG. 3).

The sheet-like film F is supplied to the bag-making and packaging unit 200 from the film roll FR that one of the two holding mechanisms 110*a*, 110*b* of the film supply unit 100 holds. In a case where the sheet-like film F is supplied from the film roll FR attached to the first shaft 111*a* of the first holding mechanism 110*a*, the film F is drawn by the first holding mechanism motor 114*a*. In a case where the sheet-like film F is supplied from the film roll FR attached to the second shaft 111*b* of the second holding mechanism 110*b*, the film F is drawn by the second holding mechanism motor 114*b*. The sheet-like film F that has been pulled out from the film roll FR is conveyed by the film conveyor belts 220 of the bag-making and packaging unit 200. The sheet-like film F that is conveyed to the bag-making and packaging unit 200 is guided by plural rollers 170 including movable rollers 185 and fixed rollers 182 of the tension adjusting mechanism 180 described later and is conveyed to the former body 212 of the former unit 210. The tension adjusting mechanism 180 uses the movable rollers 185 to cause force to act on the film F to adjust the tension in the film F that is conveyed. The former body 212 forms the sheet-like film F into a tubular shape to form the tubular film Ft. The tubular film Ft is conveyed downward by the film conveyor belts 220, and the overlapping portion of the tubular film Ft is sealed in the longitudinal direction by the longitudinal sealing mechanism 230 disposed below the former body 212. The tubular film Ft that has been sealed in the longitudinal direction (the film conveyance direction) by the longitudinal sealing mechanism 230 is conveyed further downward by the film conveyor belts 220 and is sealed in a direction intersecting (in particular, here, a direction orthogonal to) the conveyance direction of the tubular film Ft by the transverse sealing mechanism 240 disposed below the longitudinal sealing mechanism 230. The transverse sealing mechanism 240 also cuts, in the transverse direction, the transversely sealed portion of the tubular film Ft at its middle portion in the conveyance direction of the tubular film Ft to thereby make bags B whose upper and lower ends are sealed. Before the tubular film Ft is sealed by the transverse sealing mechanism 240, the articles C are supplied through the tube 214 of the former unit 210 to the inside of the tubular film Ft which is going to be the bags B. As a result, the bags B containing the articles C are made in the bag-making and packaging machine 1000. The bags B containing the articles C and made by the bag-making and packaging machine 1000 are conveyed to a downstream process by, for example, a conveyor (not shown in the drawings) disposed under the transverse sealing mechanism 240.

(2) Detailed Configuration

The bag-making and packaging unit 200, the film supply unit 100, and the controller 300 of the bag-making and packaging machine 1000 will now be described in greater detail.

(2-1) Bag-Making and Packaging Unit

The former unit 210, the film conveyor belts 220, the longitudinal sealing mechanism 230, and the transverse sealing mechanism 240 of the bag-making and packaging unit 200 will now be described.

(2-1-1) Former Unit

The former unit 210 mainly has the former body 212 and the tube 214 (see FIG. 2).

The former body 212 is disposed surrounding the open cylinder-shaped tube 214 in its circumferential direction. The former body 212 forms into a tubular shape the sheet-like film F pulled out from the film roll FR and conveyed to the former body 212 by folding the film F so that the left end portion and the right end portion of the film F overlap each other. The tubular film Ft that has been formed by the former body 212 is guided so that it wraps around the outer peripheral surface of the lower portion side of the open cylinder-shaped tube 214 and is conveyed downward in a state in which it is wrapped around the tube 214.

The tube 214 is an open cylinder-shaped member that extends in the vertical direction and whose upper and lower end portions are open. The upper portion of the tube 214 is formed in the shape of a funnel whose diameter increases heading toward the upper end side of the tube 214 (see FIG. 2). The lower portion of the tube 214 is formed with a uniform diameter (see FIG. 2). The tube 214 receives, through the opening in its upper portion, the articles C that drop thereto (see FIG. 2). The articles C that have been supplied through the opening in the upper portion of the tube 214 pass through the inside of the tube 214 and are supplied through the opening in the lower portion of the tube 214 to the inside of the tubular film Ft.

(2-1-2) Film Conveyor Belts

The bag-making and packaging unit 200 has a pair of film conveyor belts 220. The pair of film conveyor belts 220 are disposed under the former unit 210 (see FIG. 2). The pair of film conveyor belts 220 are disposed on the left side and the right side of the tube 214 of the former unit 210 around which the tubular film Ft is wrapped. FIG. 2 shows just the film conveyor belt 220 on the right side.

The pair of film conveyor belts 220 conveys to the former body 212 the film F pulled out from the film roll FR. Furthermore, the film conveyor belts 220 convey to the transverse sealing mechanism 240 the tubular film Ft that has been formed by the former body 212. Specifically, the film conveyor belts 220 suck and convey downward the tubular film Ft wrapped around the tube 214.

Each film conveyor belt 220 has a drive roller 222, a follower roller 224, and a belt 226 (see FIG. 2). The belt 226 has a sucking function. The belt 226 is entrained about the drive roller 222 and the follower roller 224. The drive roller 222 is connected to a roller drive motor (not shown in the drawings) and is driven by the roller drive motor. When the drive roller 222 is driven by the roller drive motor in a state in which the belt 226 is sucking the film, the tubular film Ft is conveyed downward.

(2-1-3) Longitudinal Sealing Mechanism

The longitudinal sealing mechanism 230 (see FIG. 2) is a mechanism that longitudinally seals (seals in the up and down direction) the overlapping portion of the tubular film Ft wrapped around the tube 214.

The longitudinal sealing mechanism 230 has a heater (not shown in the drawings), a heater belt (not shown in the drawings) that contacts the overlapping portion of the tubular film Ft, and a drive mechanism (not shown in the drawings) that drives the heater belt. The heater heats the heater belt. The drive mechanism drives the heater belt in forward and rearward directions so that the heater belt moves toward the tube 214 or moves away from the tube 214. When the heater belt is driven by the drive mechanism so that it moves toward the tube 214, the overlapping portion of the tubular film Ft wrapped around the tube 214 is sandwiched between the heater belt and the tube 214. The longitudinal sealing mechanism 230 heat-seals, in the longitudinal direction, the overlapping portion of the tubular film Ft by pushing the overlapping portion of the tubular film Ft by the heated heater belt, with a predetermined pressure, against the tube 214.

(2-1-4) Transverse Sealing Mechanism

The transverse sealing mechanism 240 is disposed below the film conveyor belts 220 and the longitudinal sealing mechanism 230 (see FIG. 2). The transverse sealing mechanism 240 is a mechanism that transversely seals the tubular film Ft conveyed downward by the film conveyor belts 220 after the tubular film Ft has been longitudinally sealed by the longitudinal sealing mechanism 230. In other words, the transverse sealing mechanism 240 is a mechanism that seals the tubular film Ft in a direction intersecting (more specifically, a direction orthogonal to) the conveyance direction of the tubular film Ft.

The transverse sealing mechanism 240 has a pair of rotating bodies 242 that are disposed in front and in back of the tubular film Ft (see FIG. 2). Attached to each rotating body 242 are a sealing jaw 244*a* and a sealing jaw 244*b* that have built-in heaters (see FIG. 2). The sealing jaws 244*a* of both rotating bodies 242 function as a pair when transversely sealing the tubular film Ft. The sealing jaws 244*b* of both rotating bodies 242 also function as a pair when transversely sealing the tubular film Ft. The pair of sealing jaws 244*a* and the pair of sealing jaws 244*b* alternately transversely seal the tubular film Ft that is conveyed thereto.

The transverse sealing of the tubular film Ft and the cutting of the tubular film Ft by the sealing jaws 244*a* will now be described.

When a drive mechanism not shown in the drawings is driven and the pair of rotating bodies 242 revolves, the sealing jaws 244*a* attached to the rotating bodies 242 revolves while tracing loci that are mutually symmetrical as seen in a side view (see the loci indicated by the dashed lines in FIG. 2). The pair of sealing jaws 244*a* that revolve sandwich the tubular film Ft in a state in which they press against each other, apply pressure and heat to the part of the tubular film Ft that becomes the upper and lower end portions of the bags B, and transversely seal the tubular film Ft. A cutter not shown in the drawings is built into one of the sealing jaws 244*a*. The cutter cuts the transversely sealed portion of the tubular film Ft in its center position in the conveyance direction of the tubular film Ft to thereby cut away the bag B from the subsequent tubular film Ft.

The transverse sealing of the tubular film Ft and the cutting of the tubular film Ft by the sealing jaws 244*b* are the same as those of the sealing jaws 244*a*, so description thereof will be omitted.

(2-2) Film Supply Unit

The film supply unit 100 will now be described with reference to more drawings.

Figure 5:
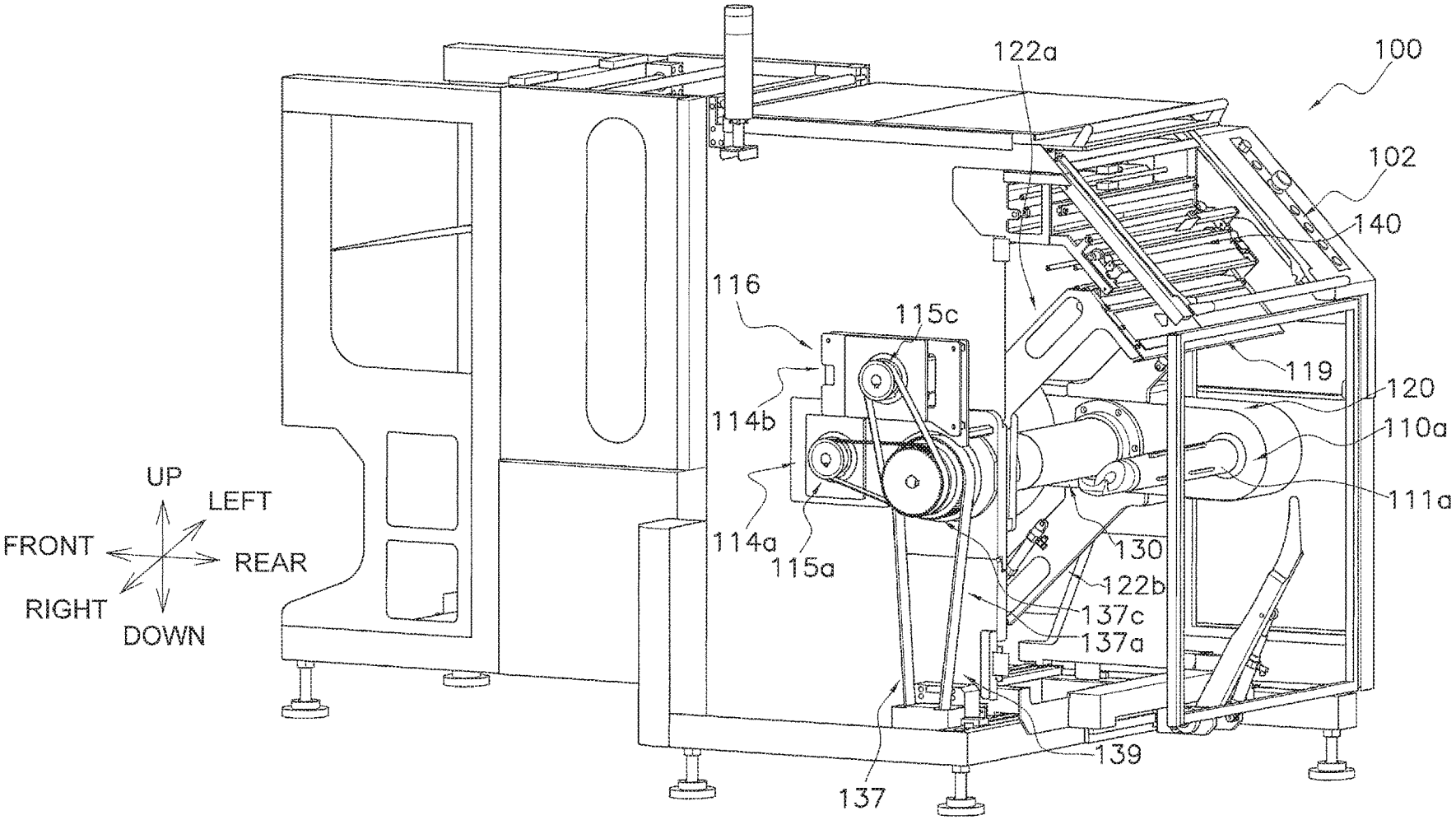
FIG. 5 is a general perspective view of a film supply unit of the bag-making and packaging machine of FIG. 2.
Figure 7:
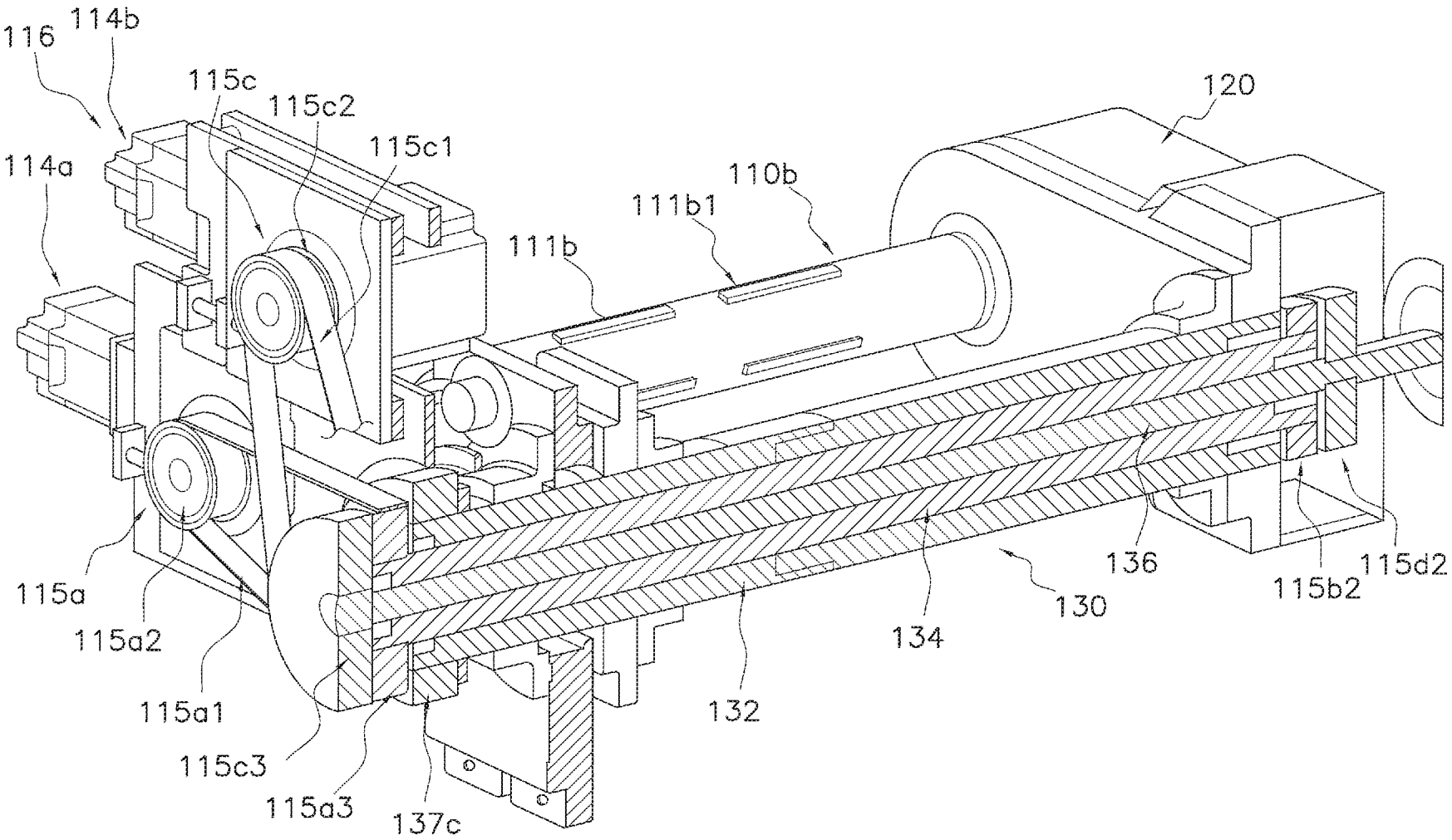
FIG. 7 is a sectional perspective view showing the internal structure of a frame shaft that rotatably supports the holding mechanism support frame of FIG. 6.
Figure 8:
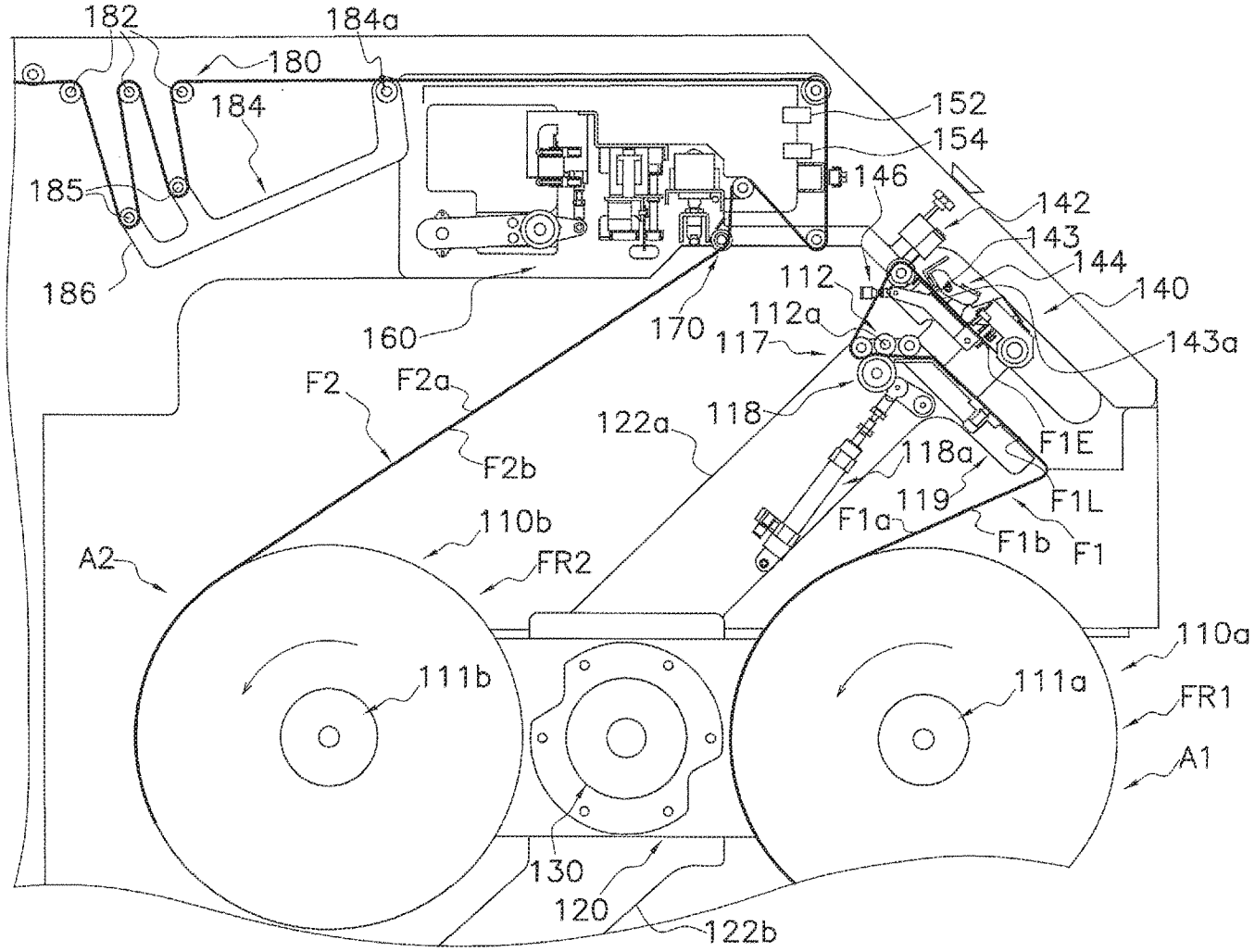
FIG. 8 is an enlarged side view of main portions of the film supply unit of FIG. 5 in a state in which a first film roll has been attached to a first holding mechanism.
Figure 9:
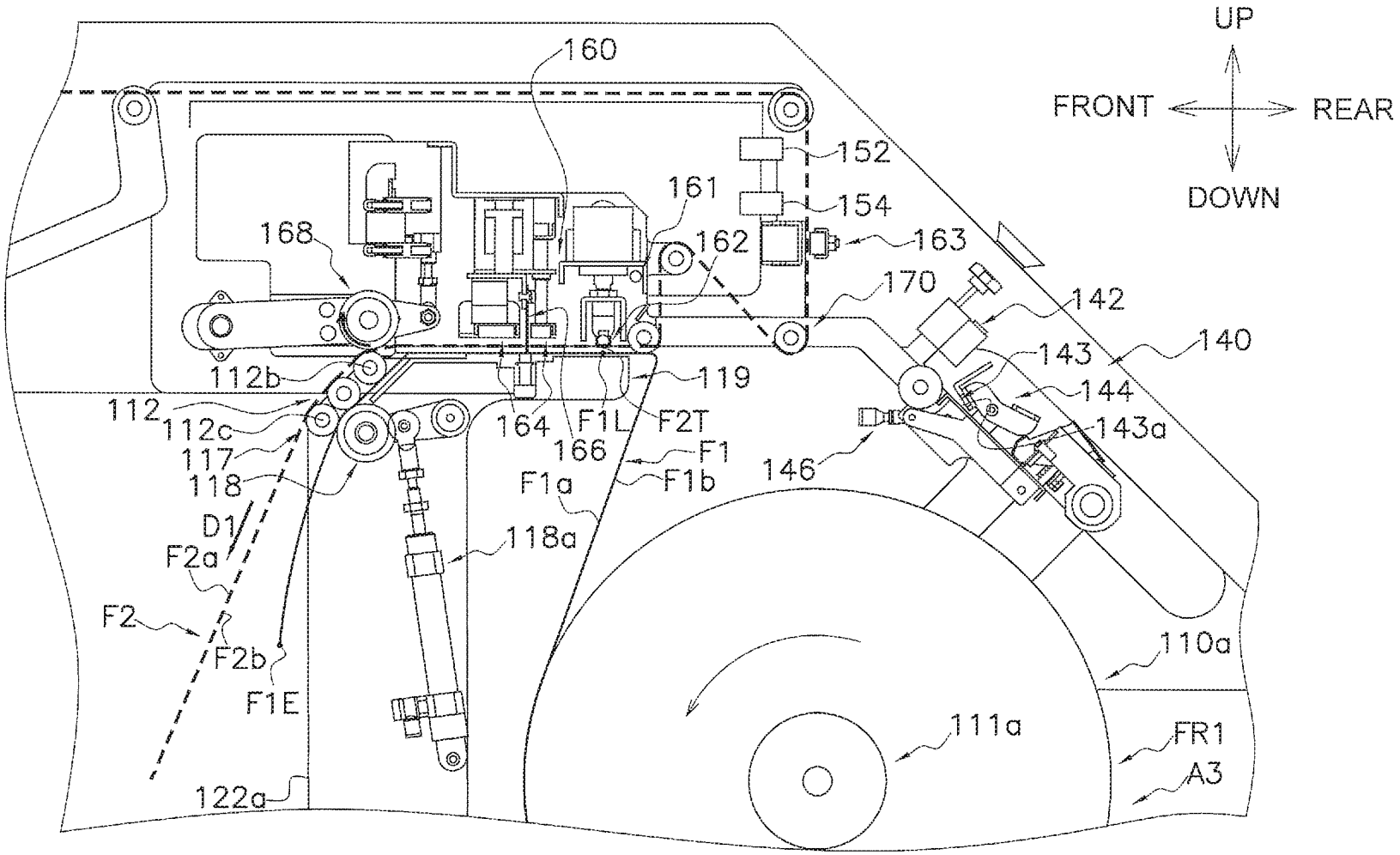
FIG. 9 is an enlarged side view of main portions of the film supply unit of FIG. 5 in a state in which the first holding mechanism has been moved to a film roll standby position.
Figure 10:
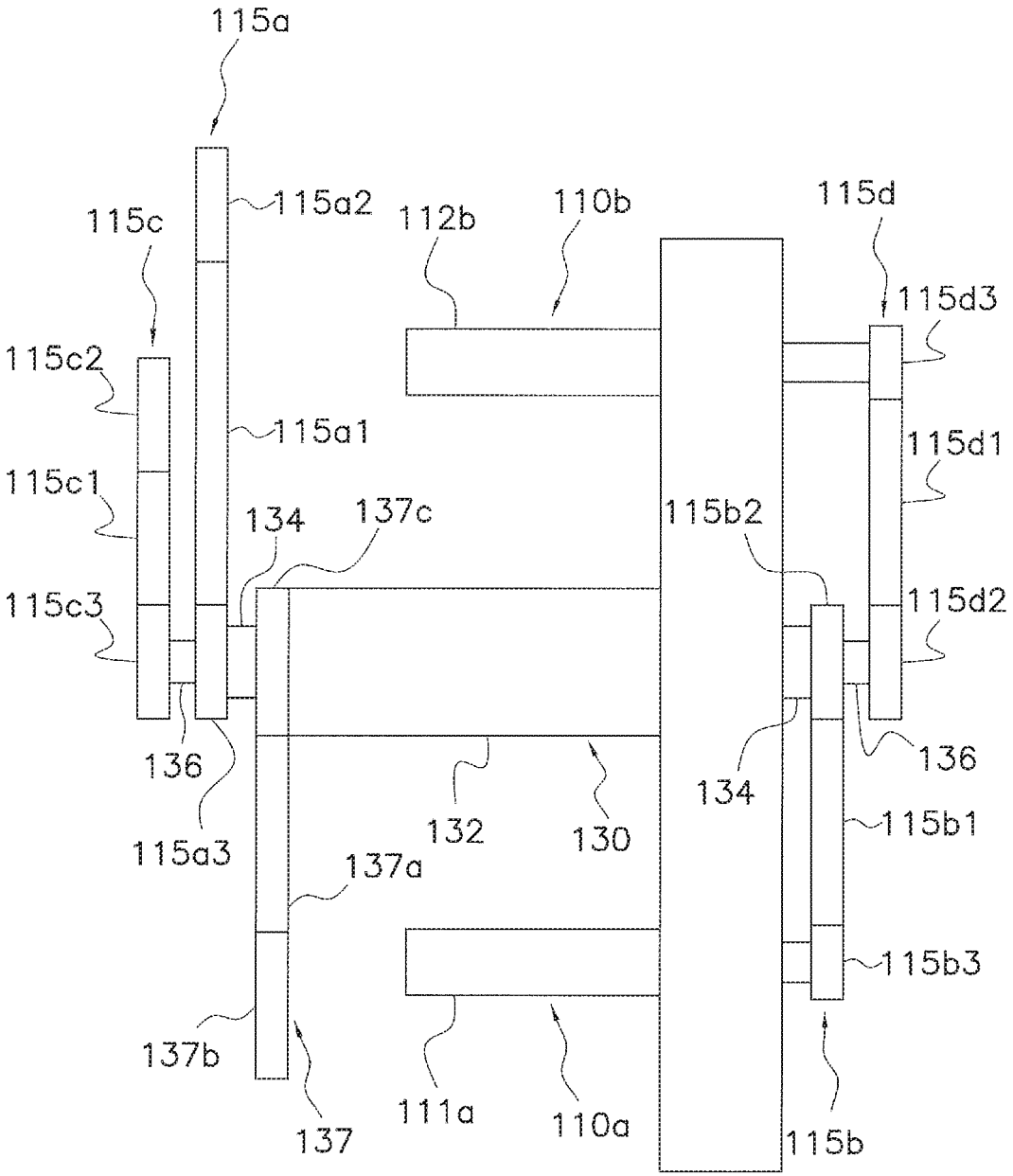
FIG. 10 is a general plan view, around the frame shaft of the film supply unit of FIG. 5, for describing the transmission of driving force to the frame shaft, a first shaft, and a second shaft.

FIG. 5 is a general perspective view of the film supply unit 100. FIG. 6 is an enlarged perspective view around a holding mechanism support frame 120 of the film supply unit 100. FIG. 7 is a sectional perspective view showing the internal structure of a frame shaft 130 that rotatably supports the holding mechanism support frame 120. FIG. 8 is an enlarged side view of main portions of the film supply unit 100 in a state in which the film rolls FR have been attached to the first holding mechanism 110*a* and the second holding mechanism 110*b*. FIG. 9 is an enlarged side view of main portions of the film supply unit 100 in a state in which the first holding mechanism 110*a* has been moved to a film roll standby position A3. FIG. 10 is a general plan view, around the frame shaft 130 of the film supply unit 100, for describing the transmission of driving force to the frame shaft 130, the first shaft 111*a*, and the second shaft 111*b*.

The film supply unit 100 is a unit that supplies the film F wound into the film rolls FR to the bag-making and packaging unit 200. In the film supply unit 100, the film F is guided to the bag-making and packaging unit 200 by the plural rollers 170 disposed along a conveyance path of the film F. The rollers 170 include the fixed rollers 182 and the movable rollers 185 of the tension adjusting mechanism 180.

The film supply unit 100 has the tension adjusting mechanism 180 that adjusts the tension that acts on the film F that is conveyed. The film supply unit 100 also has the first holding mechanism 110*a* and the second holding mechanism 110*b*, a holding mechanism support frame 120, a frame shaft 130, a moving mechanism 139, and a film drawing mechanism 116. The film supply unit 100 also has a leading end portion position adjusting mechanism 140. The film supply unit 100 also has a trailing end position adjusting/film splicing mechanism 160.

The leading end portion position adjusting mechanism 140 mainly includes a leading end portion position adjustment sensor 142, a film temporary placement member 143, a temporary restraining mechanism 144, and a terminal end position adjustment air nozzle 146. The leading end portion position adjusting mechanism 140 is used mainly for adjusting the position of the leading end portion of the film F wound into the film roll FR and the neighboring portion of the terminal end of the film F when a new film roll FR for replacement is attached to the first holding mechanism 110*a* or the second holding mechanism 110*b*.

Here, the leading end portion, the trailing end portion, and the terminal end of the film F are defined as follows.

First, in defining these terms, a case is supposed where the film F of the film roll FR (for convenience of description, hereinafter called the used film roll FR) that one of the first holding mechanism 110*a* and the second holding mechanism 110*b* holds is used up and the film F of the film roll FR (for convenience of description, hereinafter called the replacement film roll FR) that the other of the first holding mechanism 110*a* and the second holding mechanism 110*b* holds is spliced to the film F of the used film roll FR by a later-described splicing mechanism 162.

At this time, the portion of the film F of the replacement film roll FR that is spliced to the film F of the used film roll FR is called the leading end portion of the film F. Furthermore, the portion of the film F of the used film roll FR that is spliced to the leading end portion of the film F of the replacement film roll FR is called the trailing end portion of the film F. Furthermore, the terminal end of the film F here means the end on the pull-out side (the opposite side of the side connected to the winding core not shown in the drawings) of the film F wound into the replacement film roll FR. For example, using FIG. 8 and FIG. 9 as an example, the portion denoted by reference sign F1L is the leading end portion of the film F (of the replacement film roll FR), the portion denoted by reference sign F2T is the trailing end portion of the film F (of the used film roll FR), and the portion denoted by reference sign F1E is the terminal end of the film F (of the replacement film roll FR).

As described later, positional adjustment of the leading end portion of the film F of the replacement film roll FR and the trailing end portion of the film F of the used film roll FR is performed to reduce misalignment of the printing P on the film F from occurring when the film F of the replacement film roll FR and the film F of the used film roll FR are spliced together by the splicing mechanism 162.

In the following description there are cases where, in addition to the above expressions, the expression "detecting the trailing end of the film roll FR" is used. "Detecting the trailing end of the film roll FR" means detecting a state in which all the film F wound into the film roll FR has been pulled out from the film roll FR.

The trailing end position adjusting/film splicing mechanism 160 mainly includes a splicing mechanism 162, a first clamp 163, a second clamp 164, a knife 166, a pinch roller 168, a trailing end portion position adjustment first sensor 152, a trailing end portion position adjustment second sensor 154, and a cooling air electromagnetic valve 161*a*. The trailing end position adjusting/film splicing mechanism 160 is used mainly for detecting that the film F of the film roll FR (for convenience of description, hereinafter called the used film roll FR) that one of the holding mechanisms 110*a*, 110*b* holds has been used up, adjusting the position of the trailing end portion of the film F of the used film roll FR to an appropriate position, and splicing the trailing end portion of the film F of the used film roll FR to the film F of the film roll FR (for convenience of description, hereinafter called the replacement film roll FR) that the other of the holding mechanisms 110*a*, 110*b* holds.

Below, the various devices, mechanisms, and members of the film supply unit 100 will be described.

The film rolls FR that the holding mechanisms 110*a*, 110*b* hold are the same type of film roll into which the same type of sheet-like film F is wound. However, below, for convenience of description, there are cases where the film roll that the first holding mechanism 110*a* holds is called a first film roll FR1 into which sheet-like first film F1 is wound. Furthermore, there are cases where the film roll that the second holding mechanism 110*b* holds is called a second film roll FR2 into which second film F2 is wound.

(2-2-1) Holding Mechanisms

The first holding mechanism 110*a* and the second holding mechanism 110*b* are mechanisms that hold the film rolls FR (the first film roll FR1 and the second film roll FR2 respectively) in which the sheet-like film F (the first film F1 and the second film F2 respectively) is wound around hollow winding cores (not shown in the drawings) (see FIG. 6).

The first holding mechanism 110*a* has the first shaft 111*a* to which the first film roll FR1 is attached and which rotatably holds the first film roll FR1 that has been attached (see FIG. 6). The first shaft 111*a* is a cantilever shaft having one end supported by the holding mechanism support frame 120. When a connection mechanism 111*a*1 (e.g., an air chuck) is driven in a state in which the first shaft 111*a* has been inserted through the hollow winding core of the first film roll FR1, the first film roll FR1 is secured to the first shaft 111*a* (see FIG. 6). When the first shaft 111*a* is rotated by the first holding mechanism motor 114*a* in this state, the first film roll FR1 rotates together with the first shaft 111*a*.

It is preferred that the first holding mechanism 110*a* have a first guide member 119 that guides the first film F1 so that the first film F1 is disposed along a predetermined path when performing positional adjustment of the leading end portion F1L of the first film F1 wound into the first film roll FR1 after the first film roll FR1 has been attached to the first shaft 111*a* (see FIG. 8). Furthermore, it is preferred that the first holding mechanism 110*a* have a first film restraining mechanism 117 that restrains the first film F1 until the leading end portion F1L of the first film F1 and the trailing end portion F2T of the second film F2 is spliced together when the first film roll FR1 has been attached to the first shaft 111*a* and the leading end portion F1L of the first film F1 wound into the first film roll FR1 has been aligned with a prescribed position (the position where the leading end portion F1L should be disposed) in a way described later (see FIG. 8). The first film restraining mechanism 117 includes fixed rollers 112 and an air cylinder 118*a* that has a movable roller 118 attached to the distal end of a rod (see FIG. 8). When the air cylinder 118*a* is driven and the movable roller 118 is pushed against the fixed rollers 112, the first film F1 disposed between the movable roller 118 and the fixed rollers 112 is restrained between the movable roller 118 and the fixed rollers 112 (in particular, a fixed roller 112*a* disposed in the middle in the state shown in FIG. 8 out of three rollers disposed side by side). Although the air cylinder 118*a* is given here as an example of the mechanism for moving the movable roller 118, the mechanism for moving the movable roller 118 can also be a hydraulic cylinder or a motor. The first guide member 119, the fixed rollers 112, and the air cylinder 118*a* are attached to an arm 122*a* that extends from the holding mechanism support frame 120 (see FIG. 8).

The second holding mechanism 110*b* has the second shaft 111*b* to which the second film roll FR2 is attached and which rotatably holds the second film roll FR2 that has been attached (see FIG. 6). The second shaft 111*b* is a cantilever shaft having one end supported by the holding mechanism support frame 120. When a connection mechanism 111*b*1 (e.g., an air chuck) is driven in a state in which the second shaft 111*b* has been inserted through the hollow winding core of the second film roll FR2, the second film roll FR2 is secured to the second shaft 111*b* (see FIG. 6). When the second shaft 111*b* is rotated by the second holding mechanism motor 114*b* in this state, the second film roll FR2 rotates together with the second shaft 111*b*.

Although detailed description is omitted for the sake of simplifying description, it is preferred that the second holding mechanism 110*b* also have a second guide member and a second film restraining mechanism (not shown in the drawings) respectively having the same structures and functions as the first guide member 119 and the first film restraining mechanism 117.

When the film F is drawn from the film roll FR that the first holding mechanism 110*a* or the second holding mechanism 110*b* holds, the film F that has been drawn is conveyed by the film conveyor belts 220. The film F that has been pulled out from the film roll FR is guided by the plural rollers 170 including the movable rollers 185 and the fixed rollers 182 of the tension adjusting mechanism 180 and is conveyed to the former body 212 of the former unit 210 of the bag-making and packaging unit 200 (see FIG. 2).

(2-2-2) Tension Adjusting Mechanism

The tension adjusting mechanism 180 is a mechanism that adjusts the magnitude of the tension that acts on the film F that is conveyed. The tension adjusting mechanism 180 mainly has the three fixed rollers 182, a movable roller mechanism 184, a shaft 184*a*, a movable roller mechanism air cylinder 187, and an encoder 188 (see FIG. 3 and FIG. 8). The movable roller mechanism 184 has the two movable rollers 185 and a pair of arms 186 (see FIG. 8). The arms 186 are members that support the two movable rollers 185. The pair of arms 186 are disposed on the left side and the right side of the movable rollers 185, so as to sandwich the movable rollers 185 that extend in the right and left direction, and support the end portions of the movable rollers 185. The arms 186 are rotatably supported by the shaft 184*a* that extends in the right and left direction. The movable roller mechanism air cylinder 187 has a rod (not shown in the drawings) whose distal end is connected to an arm (not shown in the drawings) that extends in the radial direction from the shaft 184*a*. When the movable roller mechanism air cylinder 187 is driven, a force that causes the shaft 184*a* to rotate is generated.

The fixed rollers 182 and the movable rollers 185 are disposed on the conveyance path of the film F that is drawn from the film roll FR. The fixed rollers 182 and the movable rollers 185 are disposed between the film roll FR and the former body 212 in the conveyance direction of the film F (see FIG. 2). The fixed rollers 182 and the movable rollers 185 are all freely rotatable rollers. The fixed rollers 182 and the movable rollers 185 all extend in the right and left direction. The fixed rollers 182 are secured to a frame (not shown in the drawings) of the bag-making and packaging machine 1000, and their position does not change. In contrast, the movable rollers 185 are secured to the arms 186 that are rotatable about the axial center of the shaft 184*a* as described above, so their position is changed by the movement of the arms 186 (i.e., the movable rollers 185 are movable).

The fixed rollers 182 and the movable rollers 185 contact the film F conveyed thereto from the film roll FR and guide the film F. The film F is entrained about the fixed rollers 182 and the movable rollers 185 so that when the film F is conveyed from the film roll FR the film F sequentially contacts, from the upstream side, a fixed roller 182, a movable roller 185, a fixed roller 182, a movable roller 185, and a fixed roller 182 (see FIG. 8). The film F is entrained about the fixed rollers 182 and the movable rollers 185 in such a way that the fixed rollers 182 contact the lower surface (the printed surface Fa) of the film F that is conveyed and the movable rollers 185 contact the upper surface (the non-printed surface Fb) of the film F that is conveyed (see FIG. 8).

The movable rollers 185 that contact the upper surface of the film F conveyed thereto push the film F downward because of the resultant force of the self-weight of the movable roller mechanism 184 and the force that the movable roller mechanism air cylinder 187 produces and which causes the shaft 184*a* to rotate. As a result, the movable rollers 185 cause tension to act on the film F. By controlling the actions of the movable roller mechanism air cylinder 187, the force with which the movable rollers 185 push the film F downward changes and the tension that acts on the film F changes.

Attached to one end of the shaft 184*a* is the encoder 188 (see FIG. 3) for detecting the angle of rotation of the shaft 184*a*. The detection result of the encoder 188 is used in control of the position of the movable rollers 185 by the controller 300 described later. The detection result of the encoder 188 can also be utilized in detection of the trailing end of the film roll FR by the controller 300 described later.

When the film F is conveyed during the operation of the bag-making and packaging machine 1000, as described later the controller 300 adjusts, on the basis of the detection result of the encoder 188, the rotational speed of the shaft 111*a*, 111*b* of the holding mechanism 110*a*, 110*b* holding the film roll FR from which the film F is drawn (in other words, the drawing speed of the film F) and controls, to a predetermined position, the position of the movable rollers 185 that guide the film F. For example, when the film roll FR from which the film F is drawn is the second film roll FR2, the controller 300 adjusts the rotational speed of the second shaft 111*b* of the second holding mechanism 110*b* holding the second film roll FR2 to thereby control, to the predetermined position (a predetermined position region), the position of the movable rollers 185 that guide the second film F2.

(2-2-3) Holding Mechanism Support Frame

The holding mechanism support frame 120 is an example of a frame that supports plural film roll holding mechanisms. In this embodiment, the holding mechanism support frame 120 supports the first holding mechanism 110*a* and the second holding mechanism 110*b*. In particular, the holding mechanism support frame 120 rotatably supports the first shaft 111*a* of the first holding mechanism 110*a* and rotatably supports the second shaft 111*b* of the second holding mechanism 110*b*.

An arm 122*a* and an arm 122*b* extend from the holding mechanism support frame 120. Attached to the arm 122*a* are the first guide member 119 and the fixed rollers 112 and the air cylinder 118*a* of the first film restraining member 117 of the first holding mechanism 110*a*. Attached to the arm 122*b* are the second guide member and the fixed rollers and the air cylinder of the second film restraining mechanism (not shown in the drawings). The second guide member and the second film restraining mechanism of the second holding mechanism 110*b* respectively have the same structures and functions as the first guide member 119 and the first film restraining mechanism 117 of the first holding mechanism 110*a* except that they are for the second holding mechanism 110*b*.

(2-2-4) Frame Shaft

The frame shaft 130 is a shaft that rotatably supports the holding mechanism support frame 120.

When the holding mechanism support frame 120 rotates about the central axis of the frame shaft 130, the first shaft 111*a* of the first holding mechanism 110*a* and the second shaft 111*b* of the second holding mechanism 110*b* also rotate about the central axis of the frame shaft 130. Furthermore, when the holding mechanism support frame 120 rotates about the central axis of the frame shaft 130, the arm 122*a* and the arm 122*b* of the holding mechanism support frame 120 also rotate about the central axis of the frame shaft 130. When the holding mechanism support frame 120 rotates about the central axis of the frame shaft 130, the relative positional relationship between the first shaft 111*a* of the first holding mechanism 110*a* and the arm 122*a* of the holding mechanism support frame 120 does not change. Furthermore, when the holding mechanism support frame 120 rotates about the central axis of the frame shaft 130, the relative positional relationship between the second shaft 111*b* of the second holding mechanism 110*b* and the arm 122*b* of the holding mechanism support frame 120 does not change.

The frame shaft 130 has a multilayer shaft structure. Here, the frame shaft 130 has a three-layer shaft structure. The frame shaft 130 includes a first layer shaft 132 that is disposed as the outermost layer and is the largest in diameter, a third layer shaft 136 that is disposed as the innermost layer and is the smallest in diameter, and a second layer shaft 134 that is disposed between the first layer shaft 132 and the third layer shaft 136 (see FIG. 7). The first layer shaft 132, the second layer shaft 134, and the third layer shaft 136 can rotate respectively independently.

The first layer shaft 132 is a shaft for rotating the holding mechanism support frame 120. One end of the first layer shaft 132 is secured to the holding mechanism support frame 120. When the first layer shaft 132 is rotated by the moving mechanism 139 as described later, the holding mechanism support frame 120 rotates.

The second layer shaft 134 is a shaft for rotating the first shaft 111*a* of the first holding mechanism 110*a*. When the second layer shaft 134 is rotated by the film drawing mechanism 116 as described later, the first shaft 111*a* of the first holding mechanism 110*a* rotates. Specifically, when the second layer shaft 134 is rotated by the first holding mechanism motor 114*a* of the film drawing mechanism 116, the first shaft 111*a* of the first holding mechanism 110*a* is rotated and the first film F1 is drawn from the first film roll FR1 attached to the first shaft 111*a*.

The third layer shaft 136 is a shaft for rotating the second shaft 111*b* of the second holding mechanism 110*b*. When the third layer shaft 136 is rotated by the film drawing mechanism 116 as described later, the second shaft 111*b* of the second holding mechanism 110*b* rotates. Specifically, when the third layer shaft 136 is rotated by the second holding mechanism motor 114*b* of the film drawing mechanism 116, the second shaft 111*b* of the second holding mechanism 110*b* is rotated and the second film F2 is drawn from the second film roll FR2 attached to the second shaft 111*b*.

(2-2-5) Moving Mechanism

The moving mechanism 139 rotates the holding mechanism support frame 120 to thereby move the first holding mechanism 110*a* and the second holding mechanism 110*b* between at least a film roll setting position A1 and a film supply position A2. Preferably, the moving mechanism 139 also rotates the holding mechanism support frame 120 to thereby move one of the first holding mechanism 110*a* and the second holding mechanism 110*b* to a film roll standby position A3 and move the other of the first holding mechanism 110*a* and the second holding mechanism 110*b* to a film supply position A4. The film roll setting position A1 of the first holding mechanism 110*a* and the second holding mechanism 110*b* is the position where the first holding mechanism 110*a* is disposed in FIG. 8. The film supply position A2 of the first holding mechanism 110*a* and the second holding mechanism 110*b* is the position where the second holding mechanism 110*b* is disposed in FIG. 8. The film roll standby position A3 of the first holding mechanism 110*a* and the second holding mechanism 110*b* is the position where the first holding mechanism 110*a* is disposed in FIG. 2 and FIG. 9. The film supply position A4 of the first holding mechanism 110*a* and the second holding mechanism 110*b* is the position where the second holding mechanism 110*b* is disposed in FIG. 2. The film roll standby position A3 is a position rotated by a predetermined angle (e.g., 45°) counter-clockwise around the frame shaft 130 from the film roll setting position A1 about the central axis of the frame shaft 130 as seen in a right side view. Although it is not limited, the film supply position A2 is a position rotated by a predetermined angle (e.g., 135°) counter-clockwise around the frame shaft 130 from the film roll standby position A3 about the central axis of the frame shaft 130 as seen in a right side view. The film supply position A4 is a position rotated by a predetermined angle (e.g., 45°) counter-clockwise around the frame shaft 130 from the film supply position A2 about the central axis of the frame shaft 130 as seen in a right side view.

The film roll setting position A1 is a position where the film roll FR is attached to the first shaft 111*a* of the first holding mechanism 110*a* and the second shaft 111*b* of the second holding mechanism 110*b*. That is, in this bag-making and packaging machine 1000, the film roll FR is attached to the shafts 111*a*, 111*b* at the same position to both of the first holding mechanism 110*a* and the second holding mechanism 110*b*.

The film supply positions A2, A4 are positions where the film F supplied to the bag-making and packaging unit 200 is drawn from the film roll FR attached to the shafts 111*a*, 111*b* at the time of the bag-making and packaging actions of the bag-making and packaging machine 1000. That is, one of the holding mechanisms 110*a*, 110*b* holding the film roll FR that supplies the film F to the bag-making and packaging unit 200 is disposed mainly in one of the film supply position A2 and the film supply position A4 when the bag-making and packaging actions are performed in the bag-making and packaging unit 200.

The film roll standby position A3 is a position where the first holding mechanism 110*a* to whose first shaft 111*a* the first film roll FR1 was attached in the film roll setting position A1 stands by until the second film F2 of the second film roll FR2 that the second holding mechanism 110*b* is holding is used up. Furthermore, the film roll standby position A3 is a position where the second holding mechanism 110*b* to whose second shaft 111*b* the second film roll FR2 was attached in the film roll setting position A1 stands by until the first film F1 of the first film roll FR1 that the first holding mechanism 110*a* is holding is used up.

Furthermore, the film roll standby position A3 is a position where the first holding mechanism 110*a* is disposed when the leading end portion F1L of the first film F1 of the first film roll FR1 attached to the first shaft 111*a* of the first holding mechanism 110*a* is spliced, by the splicing mechanism 162 described later, to the trailing end portion F2T of the second film F2 of the second film roll FR2 attached to the second shaft 111*b* of the second holding mechanism 110*b*. That is, when the first holding mechanism 110*a* has been moved to the film roll standby position A3, the leading end portion F1L of the first film F1 is moved to a position (called a splicing position) where it is spliced by the splicing mechanism 162 to the trailing end portion F2T of the second film F2. Likewise, the film roll standby position A3 is a position where the second holding mechanism 110*b* is disposed when the leading end portion (not shown in the drawings) of the second film F2 of the second film roll FR2 attached to the second shaft 111*b* of the second holding mechanism 110*b* is spliced, by the splicing mechanism 162 described later, to the trailing end portion (not shown in the drawings) of the first film F1 of the first film roll FR1 attached to the first shaft 111*a* of the first holding mechanism 110*a*. When the second holding mechanism 110*b* has been moved to the film roll standby position A3, the leading end portion of the second film F2 is moved to the position (the splicing position) where it is spliced by the splicing mechanism 162 to the trailing end portion of the first film F1.

The structure of the moving mechanism 139 will now be described.

The moving mechanism 139 mainly includes a frame rotation motor 138 and a frame rotation transmission mechanism 137. The frame rotation motor 138 is a motor for rotating the holding mechanism support frame 120. The frame rotation transmission mechanism 137 is a mechanism that transmits the driving force of the frame rotation motor 138 to the first layer shaft 132 of the frame shaft 130.

The frame rotation transmission mechanism 137 includes a belt 137*a*, a drive roller 137*b*, and a follower roller 137*c*. The belt 137*a* is entrained about the drive roller 137*b* and the follower roller 137*c*. The drive roller 137*b* is connected to the frame rotation motor 138 and is driven by the frame rotation motor 138. The follower roller 137*c* is connected to one end of the first layer shaft 132 of the frame shaft 130 (the end portion of the first layer shaft 132 on the side not connected to the holding mechanism support frame 120). When the frame rotation motor 138 is driven, the drive roller 137*b* rotates, the follower roller 137*c* rotates via the belt 137*a*, and the first layer shaft 132 also rotates. As a result of the first layer shaft 132 rotating, the holding mechanism support frame 120 is rotated and the first holding mechanism 110*a* and the second holding mechanism 110*b* are moved.

Detection of the posture of the holding mechanism support frame 120 that is rotated by the moving mechanism 139 can be realized inexpensively by a mechanism 400 such as described below, for example.

Figure 11:
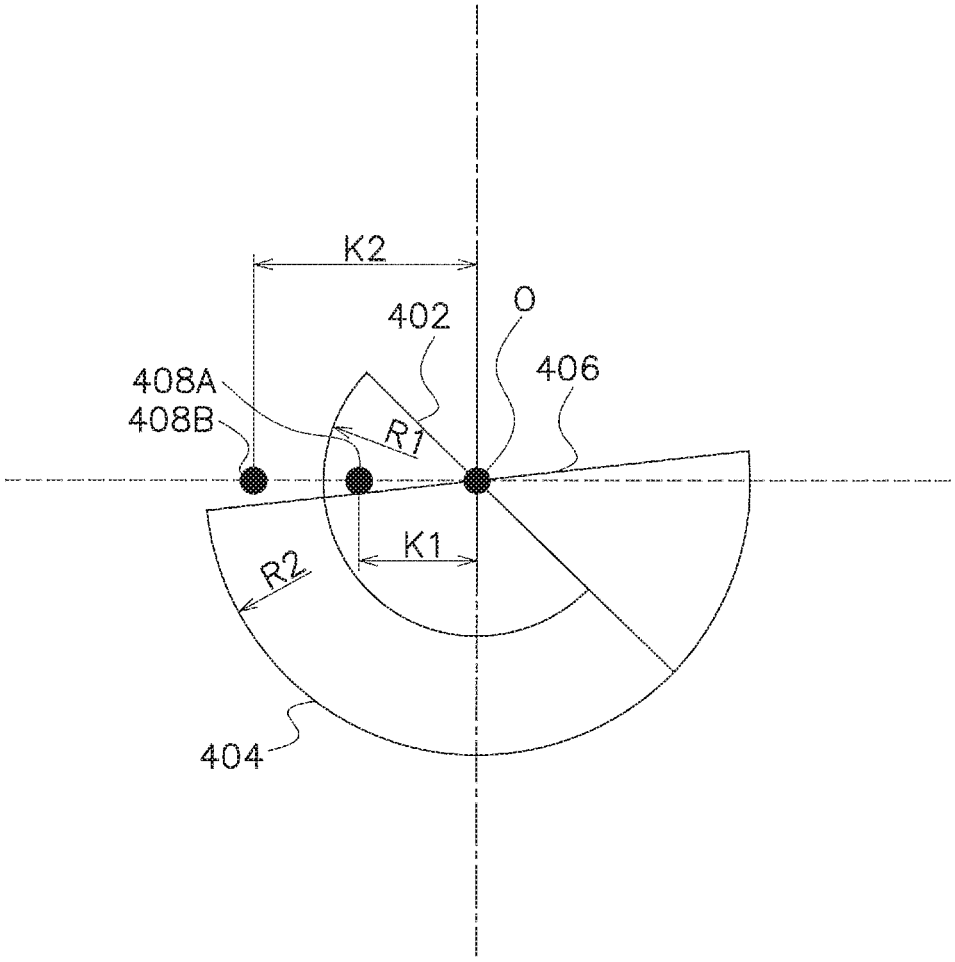
FIG. 11 is a drawing for describing a posture detection mechanism for detecting the posture of the holding mechanism support frame of FIG. 6.

As shown in FIG. 11, the mechanism 400 for detecting the posture of the holding mechanism support frame 120 has a first member 402, a second member 404, and a third member 406, which are all secured to an end portion of the first layer shaft 132 (which all rotate together with the first layer shaft 132), and two photoelectric sensors 408A, 408B. The first member 402 is a plate formed in the shape of a fan with a radius R1 centered on a rotational axis O of the first layer shaft 132 when the end portion of the first layer shaft 132 to which the first member 402 is attached is seen from the side. The second member 404 is a plate having a shape such as in FIG. 11 in which its outer peripheral side is defined by a circular arc with a radius R2 (>R1) centered on the rotational axis O of the first layer shaft 132, its inner peripheral side is defined by a circular arc with a radius R1 centered on the rotational axis O of the first layer shaft 132, and these circular arcs are connected by two straight lines extending in the radial direction with respect to the rotational axis O when the end portion of the first layer shaft 132 to which the second member 404 is attached is seen from the side. The third member 406 is a plate formed in the shape of a fan with a radius R2 centered on the rotational axis O of the first layer shaft 132 when the end portion of the first layer shaft 132 to which the third member 406 is attached is seen from the side. The photoelectric sensor 408A detects whether or not the first member 402 and the third member 406 are present in a position located a distance K1 (K1<R1) from the rotational center O when the end portion of the first layer shaft 132 to which the first member 402 is attached is seen from the side. The photoelectric sensor 408B is disposed on a straight line interconnecting the rotational center O and the photoelectric sensor 408A and detects whether or not the second member 404 and the third member 406 are present in a position located a distance K2 (R1<K2<R2) away from the rotational center O when the end portion of the first layer shaft 132 to which the first member 402 is attached is seen from the side. The positions of the two photoelectric sensors 408A, 408B do not change regardless of the rotation of the first layer shaft 132.

The first member 402, the second member 404, and the third member 406 are disposed in such a way that when detection of the members 402, 404, 406 is performed using the two photoelectric sensors 408A, 408B as in FIG. 11, depending on the angle of rotation of the first layer shaft 132, there arise a state in which just one of the two photoelectric sensors 408A, 408B is detecting a member, a state in which both of the two photoelectric sensors 408A, 408B are detecting a member, and a state in which neither of the two photoelectric sensors 408A, 408B is detecting a member. By utilizing combinations of the detection results of the two photoelectric sensors 408A, 408B, the rough angle of rotation of the first layer shaft 132, and therefore the posture of the holding mechanism support frame 120, can be detected.

Here, a case where the three members 402, 404, 406 are attached to the end portion of the first layer shaft 132 and the two photoelectric sensors 408A, 408B are used is described as an example. The posture of the holding mechanism support frame 120 can be detected with even greater precision by using the above detection principle and increasing the quantity of members and photoelectric sensors.

(2-2-6) Film Drawing Mechanism

The film drawing mechanism 116 respectively independently rotates the shafts (the first shaft 111*a* and the second shaft 111*b*) of the plural holding mechanisms (the first holding mechanism 110*a* and the second holding mechanism 110*b*) to thereby draw the film (the first film F1 and the second film F2) from the film rolls (the first film roll FR1 and the second film roll FR2) attached to the shafts of the plural holding mechanisms. The film drawing mechanism 116 is configured to be capable of changing the drawing speed of the first film roll FR1 and the second film roll FR2 at the time of the bag-making and packaging actions in the bag-making and packaging unit 200.

The film drawing mechanism 116 includes the first holding mechanism motor 114*a*, the second holding mechanism motor 114*b*, a first transmission mechanism 115*a*, a second transmission mechanism 115*b*, a third transmission mechanism 115*c*, and a fourth transmission mechanism 115*d*.

The first holding mechanism motor 114*a* rotates the first shaft 111*a* of the first holding mechanism 110*a* out of the plural holding mechanisms 110*a*, 110*b*. The first holding mechanism motor 114*a* preferably is a servo motor. The first transmission mechanism 115*a* transmits the driving force of the first holding mechanism motor 114*a* to the second layer shaft 134 of the frame shaft 130. The second transmission mechanism 115*b* transmits the driving force that has been transmitted to the second layer shaft 134 of the frame shaft 130 to the first shaft 111*a* of the first holding mechanism 110*a* that is the driving target of the first holding mechanism motor 114*a*.

The first transmission mechanism 115*a* includes a belt 115*a*1, a drive roller 115*a*2, and a follower roller 115*a*3. The belt 115*a*1 is entrained about the drive roller 115*a*2 and the follower roller 115*a*3. The drive roller 115*a*2 is connected to the first holding mechanism motor 114*a* and is driven by the first holding mechanism motor 114*a*. The follower roller 115*a*3 is connected to one end of the second layer shaft 134 of the frame shaft 130. When the first holding mechanism motor 114*a* is driven, the drive roller 115*a*2 rotates, the follower roller 115*a*3 rotates via the belt 115*a*1, and the second layer shaft 134 also rotates.

The second transmission mechanism 115*b* includes a belt 115*b*1, a drive roller 115*b*2, and a follower roller 115*b*3. The belt 115*b*1 is entrained about the drive roller 115*b*2 and the follower roller 115*b*3. The drive roller 115*b*2 is connected to one end (the end portion on the opposite side of the side where the follower roller 115*a*3 is connected) of the second layer shaft 134 of the frame shaft 130, and when the second layer shaft 134 rotates, the drive roller 115*b*2 also rotates. The follower roller 115*b*3 is connected to one end (the end portion on the side supported by the holding mechanism support frame 120) of the first shaft 111*a* of the first holding mechanism 110*a*. When the second layer shaft 134 rotates, the drive roller 115*b*2 rotates, the follower roller 115*b*3 rotates via the belt 115*b*1, and the first shaft 111*a* of the first holding mechanism 110*a* also rotates.

Because the first transmission mechanism 115*a* and the second transmission mechanism 115*b* are configured as described above, when the first holding mechanism motor 114*a* is driven, the driving force of the first holding mechanism motor 114*a* is transmitted via the first transmission mechanism 115*a* and the second transmission mechanism 115*b* to the first shaft 111*a* of the first holding mechanism 110*a*, whereby the first shaft 111*a* is rotated. As a result, the first film F1 is drawn from the first film roll FR1 attached to the first shaft 111*a* of the first holding mechanism 110*a*.

The second holding mechanism motor 114*b* rotates the second shaft 111*b* of the second holding mechanism 110*b* out of the plural holding mechanisms 110*a*, 110*b*. The second holding mechanism motor 114*b* preferably is a servo motor. The third transmission mechanism 115*c* transmits the driving force of the second holding mechanism motor 114*b* to the third layer shaft 136 of the frame shaft 130. The fourth transmission mechanism 115*d* transmits the driving force that has been transmitted to the third layer shaft 136 of the frame shaft 130 to the second shaft 111*b* of the second holding mechanism 110*b* that is the driving target of the second holding mechanism motor 114*b*.

The third transmission mechanism 115*c* includes a belt 115*c*1, a drive roller 115*c*2, and a follower roller 115*c*3. The belt 115*c*1 is entrained about the drive roller 115*c*2 and the follower roller 115*c*3. The drive roller 115*c*2 is connected to the second holding mechanism motor 114*b* and is driven by the second holding mechanism motor 114*b*. The follower roller 115*c*3 is connected to one end of the third layer shaft 136 of the frame shaft 130. When the second holding mechanism motor 114*b* is driven, the drive roller 115*c*2 rotates, the follower roller 115*c*3 rotates via the belt 115*c*1, and the third layer shaft 136 also rotates.

The fourth transmission mechanism 115*d* includes a belt 115*d*1, a drive roller 115*d*2, and a follower roller 115*d*3. The belt 115*d*1 is entrained about the drive roller 115*d*2 and the follower roller 115*d*3. The drive roller 115*d*2 is connected to one end (the end portion on the opposite side of the side where the follower roller 115*c*3 is connected) of the third layer shaft 136 of the frame shaft 130, and when the third layer shaft 136 rotates, the drive roller 115*d*2 also rotates. The follower roller 115*d*3 is connected to one end (the end portion on the side supported by the holding mechanism support frame 120) of the second shaft 111*b* of the second holding mechanism 110*b*. When the third layer shaft 136 rotates, the drive roller 115*d*2 rotates, the follower roller 115*d*3 rotates via the belt 115*d*1, and the second shaft 111*b* of the second holding mechanism 110*b* also rotates.

Because the third transmission mechanism 115*c* and the fourth transmission mechanism 115*d* are configured as described above, when the second holding mechanism motor 114*b* is driven, the driving force of the second holding mechanism motor 114*b* is transmitted via the third transmission mechanism 115*c* and the fourth transmission mechanism 115*d* to the second shaft 111*b* of the second holding mechanism 110*b*, whereby the second shaft 111*b* is rotated. As a result, the second film F2 is drawn from the second film roll FR2 attached to the second shaft 111*b* of the second holding mechanism 110*b*.

(2-2-7) Splicing Mechanism

The splicing mechanism 162 is a mechanism that splices together the first film F1 wound into the first film roll FR1 attached to the first shaft 111*a* of the first holding mechanism 110*a* and the second film F2 wound into the second film roll FR2 attached to the second shaft 111*b* of the second holding mechanism 110*b*. The splicing mechanism 162 is a mechanism that sandwiches the first film F1 and the second film F2 between itself and the first guide member 119 or the second guide member (not shown in the drawings) and applies pressure to the first film F1 and the second film F2 and heat the first film F1 and the second film F2 using a heater (not shown in the drawings) to thereby heat-weld the first film F1 and the second film F2 to each other. However, the splicing method is not limited to heat welding, and the splicing mechanism 162 can be a mechanism that splices together the first film F1 and the second film F2 by ultrasonic welding.

When the second film F2 of the second film roll FR2 has been used up, the splicing mechanism 162 splices together the trailing end portion F2T of the second film F2 wound into the second film roll FR2 attached to the second shaft 111*b* of the second holding mechanism 110*b* and the leading end portion F1L of the first film F1 wound into the first film roll FR1 attached to the first shaft 111*a* of the first holding mechanism 110*a*. Furthermore, when the first film F1 of the first film roll FR1 has been used up, the splicing mechanism 162 splices together the trailing end portion (not shown in the drawings) of the first film F1 wound into the first film roll FR1 attached to the first shaft 111*a* of the first holding mechanism 110*a* and the leading end portion (not shown in the drawings) of the second film F2 wound into the second film roll FR2 attached to the second shaft 111*b* of the second holding mechanism 110*b*.

(2-2-8) Leading End Portion Position Adjusting Mechanism

The leading end portion position adjusting mechanism 140 is a mechanism used mainly for adjusting the position of the leading end portion of the film F wound into the film roll FR and the neighboring portion of the terminal end of the film F when the replacement film roll FR has been attached to the first holding mechanism 110*a* or the second holding mechanism 110*b*. The leading end portion position adjusting mechanism 140 includes the leading end portion position adjustment sensor 142, the film temporary placement member 143, the temporary restraining mechanism 144, and the terminal end position adjustment air nozzle 146 (see FIG. 8).

(2-2-8-1) Leading End Portion Position Adjustment Sensor

The leading end portion position adjustment sensor 142 is a sensor that detects that the leading end portion of the film F is positioned in the prescribed position when a film roll FR is attached to the first shaft 111*a* and the second shaft 111*b* of the first holding mechanism 110*b* and the second holding mechanism 110*b* disposed in the film roll setting position A1 and the operator sets the leading end portion of the film F wound into that film roll FR in the prescribed position. In a case when the leading end portion of the film F is disposed in the prescribed position, the leading end portion of the film F is disposed in the splicing position where the film F is spliced by the splicing mechanism 162 when the holding mechanisms 110*a*, 110*b*, to which the film roll FR has been set at the film roll setting position A1, are moved by the moving mechanism 139 to the film roll standby position A3. The leading end portion position adjustment sensor 142 can directly detect that the leading end portion of the film F is positioned in the prescribed position or can detect that a predetermined part (a part other than the leading end portion) of the film F is positioned in a target position (a position by which, when the predetermined part of the film F is in that position, the leading end portion of the film F becomes positioned in the prescribed position).

The leading end portion position adjustment sensor 142 is disposed above the film temporary placement member 143.

The leading end portion position adjustment sensor 142 is, for example, a register mark sensor that detects the register marks M printed on the printed surface Fa of the film F. Here, the leading end portion position adjustment sensor 142 detects that a register mark M is positioned in the target position (the detection position of the leading end portion position adjustment sensor 142) and thereby detects, on the basis of the detection result, that the leading end portion of the film F is positioned in the prescribed position.

The type of the leading end portion position adjustment sensor 142 is not limited to a register mark sensor and, for example, can also be a sensor utilizing a camera. For example, the leading end portion position adjustment sensor can detect that the leading end portion of the film F is positioned in the prescribed position on the basis of the position of the printing P on the printed surface Fa of the film F imaged by the camera.

(2-2-8-2) Film Temporary Placement Member

The film temporary placement member 143 is a member on which the neighborhood of the leading end portion of the film F pulled out from the film roll FR is manually temporarily placed when the operator of the bag-making and packaging machine 1000 attaches the replacement film roll FR to the holding mechanisms 110*a*, 110*b*, namely, attaches the replacement film roll FR to the shafts 111*a*, 111*b* of the holding mechanisms 110*a*, 110*b*. The film temporary placement member 143 has a temporary placement surface 143*a* on which the film F is temporarily placed.

Details relating to the film temporary placement member 143 will now be further described taking as an example the action of setting the film F (the first film F1) that the operator of the bag-making and packaging machine 1000 attaches the replacement film roll FR (the first film roll FR1) to the first holding mechanism 110*a*. The action of setting the film F (the second film F2) performed when attaching the replacement film roll FR (the second film roll FR2) to the second holding mechanism 110*b* is the same as the action of setting the first film F1, so description thereof will be omitted.

After the operator of the bag-making and packaging machine 1000 has attached the replacement first film roll FR1 to the first holding mechanism 110*a*, the operator guides the first film F1 so that the first film F1 of the first film roll FR1 travels a predetermined path. Specifically, after the operator has attached the first film roll FR1 to the first shaft 111*a* of the first holding mechanism 110*a*, the operator guides the first film F1 so that the first film F1 pulled out from the first film roll FR1 extends along the upper surface of the first guide member 119 and passes between the fixed rollers 112 and the movable roller 118 of the first film restraining mechanism 117. Moreover, the operator manually temporarily places, on the temporary placement surface 143*a* of the film temporary placement member 143, the neighborhood of the leading end portion of the film F pulled out from the film roll FR. Preferably, the operator temporarily places the first film F1 on the temporary placement surface 143*a* of the film temporary placement member 143 in such a way that the register mark M printed on the printed surface F1*a* of the first film F1 and located in the neighborhood of the terminal end RE of the first film F1 is disposed in a predetermined position range of the film temporary placement member 143 (e.g., in a position range of about 50 mm in the length direction of the first film F1). It is preferred that the position of the film temporary placement member 143 be designed in such a way that the leading end portion F1L of the first film F1 is disposed in a predetermined position range with respect to the prescribed position in the conveyance path on which the first film F1 is conveyed by the first holding mechanism motor 114*a* as described later, when the register mark M printed on the printed surface F1*a* of the first film F1 is temporarily placed in the predetermined position range of the film temporary placement member 143 when attaching the first film roll FR1 to the first holding mechanism 110*a*. More preferably, it is preferred that the position of the film temporary placement member 143 be designed in such a way that the leading end portion F1L of the first film F1 is disposed on the upstream side of the prescribed position and in a predetermined position range with respect to the prescribed position in the conveyance path on which the first film F1 is conveyed by the first holding mechanism motor 114*a*, when the register mark M printed on the printed surface F1*a* of the first film F1 is temporarily placed in the predetermined position range of the film temporary placement member 143 when attaching the first film roll FR1 to the first holding mechanism 110*a*.

In this embodiment, the film F pulled out from the film roll FR of the holding mechanisms 110*a*, 110*b* disposed in the film roll setting position A1 is temporarily placed on the film temporary placement member 143 in a state in which, as in FIG. 8, the non-printed surface Fb thereof (in FIG. 8, the non-printed surface F1*b* of the first film F1) faces the temporary placement surface 143*a* of the film temporary placement member 143. In other words, in this embodiment, the film F pulled out from the film roll FR disposed in the film roll setting position A1 is temporarily placed on the film temporary placement member 143 in a state in which, as in FIG. 8, the printed surface Fa thereof faces upward (the side visible to the operator). For that reason, it is easy for the operator to temporarily place the register mark M in the predetermined position of the film temporary placement member 143. The film F pulled out from the film roll FR of the holding mechanisms 110*a*, 110*b* disposed in the film supply position A2 has its non-printed surface Fb facing the back surface side as in FIG. 8. For that reason, if the operator were to try to perform alignment work in regard to the film F pulled out from the film roll FR of the holding mechanisms 110*a*, 110*b* disposed in the film supply position A2, the work would tend to be complicated.

In a case where the length of the first film F1 extending rearward from the film temporary placement member 143 is too long when the first film F1 has been temporarily placed in such a way that the register mark M located in the neighborhood of the terminal end RE of the first film F1 is disposed in the predetermined position range of the film temporary placement member 143, the part of the first film F1 on the rear side of the film temporary placement member 143 can be manually or automatically cut to prevent the first film F1 from getting entangled with the members inside the film supply unit 100.

(2-2-8-3) Temporary Restraining Mechanism

The temporary restraining mechanism 144 is disposed in the neighborhood of the film temporary placement member 143. The temporary restraining mechanism 144 is a mechanism that temporarily restrains the film F to reduce misalignment of the film F when the film F is temporarily placed on the film temporary placement member 143. The temporary restraining mechanism 144 temporarily restrains the film F with a force which allows conveyance of the film F when the film F is conveyed by the holding mechanism motors 114*a*, 114*b* as described later. Although it is not limited, the temporary restraining mechanism 144 temporarily restrains the film F with the force of an elastic member such as a spring. The temporary restraining mechanism 144 can be operated manually or can be driven to temporarily restrain the film F automatically by, for example, operating a button.

(2-2-8-4) Terminal End Position Adjustment Air Nozzle

The terminal end position adjustment air nozzle 146 blows air onto the neighborhood of the terminal end on the leading end portion side of the film F to perform positional adjustment of the neighborhood of the terminal end of the film F when the holding mechanisms 110*a*, 110*b* are moved by the moving mechanism 139 from the film roll setting position A1 to the film roll standby position A3, or in other words when the leading end portion of the film F is moved to the splicing position where it is spliced by the splicing mechanism 162. The blowing-out of the air from the terminal end position adjustment air nozzle 146 is controlled by a terminal end position adjustment air electromagnetic valve 146*a* (see FIG. 3).

The positional adjustment of the neighborhood of the terminal end of the film F by the terminal end position adjustment air nozzle 146 will now be described taking as an example positional adjustment of the neighborhood of the terminal end of the first film F1.

When the moving mechanism 139 rotates the holding mechanism support frame 120 by the predetermined angle counter-clockwise to move the first holding mechanism 110*a* from the film roll setting position A1 to the film roll standby position A3, the terminal end position adjustment air nozzle 146 blows air forwardly onto the printed surface F1*a* (the surface on the rear side) in the neighborhood of the terminal end F1E on the leading end portion F1L side of the first film F1. As a result, the first film F1 is positionally adjusted to a state in which it hangs down from the first film restraining mechanism 117 without wrapping around the fixed rollers 112 or the second film F2 that is being utilized for bag-making (see FIG. 9).

(2-2-9) Trailing End Position Adjusting/Film Splicing Mechanism

The trailing end position adjusting/film splicing mechanism 160 includes the splicing mechanism 162, the first clamp 163, the second clamp 164, the knife 166, the pinch roller 168, the trailing end portion position adjustment first sensor 152, the trailing end portion position adjustment second sensor 154, and the cooling air electromagnetic valve 161*a* (see FIG. 3 and FIG. 9).

(2-2-9-1) Splicing Mechanism

The splicing mechanism 162 is a mechanism that splices together the trailing end portion of the film F wound into the film roll FR attached to the shafts 111*a*, 111*b* of one of the holding mechanisms 110*a*, 110*b* and the leading end portion of the film F wound into the film roll FR attached to the shafts 111*b*, 111*a* of the other of the holding mechanisms 110*b*, 110*a*. The splicing mechanism 162 is a mechanism that heat-welds the films F using a heater not shown in the drawings as a heat source. However, the method of splicing together the films F is not limited to heat welding, and the splicing mechanism 162 can also be a mechanism that splices together the films F by ultrasonic welding, for example.

Referring to FIG. 9, for example, the splicing mechanism 162 applies heat to and heat-welds, in a state in which the trailing end portion F2T of the second film F2 and the leading end portion F1L of the first film F1 are sandwiched between the splicing mechanism 162 and the guide member 119 secured to the arm 122*a*, the trailing end portion F2T of the second film F2 wound into the second film roll FR2 attached to the second shaft 111*b* of the second holding mechanism 110*b* and the leading end portion F1L of the first film F1 wound into the first film roll FR1 attached to the first shaft 111*a* of the first holding mechanism 110*a*.

(2-2-9-2) First Clamp and Second Clamp

The first clamp 163 and the second clamp 164 are disposed along the conveyance path of the film F when supplying the film F to the bag-making and packaging unit 200. The first clamp 163 and the second clamp 164 are members that clamp and secure the film F to reduce misalignment of the trailing end portion of the film F of the used film roll FR after the trailing end portion of the film F of the used film roll FR has been positionally adjusted to the splicing position of the splicing mechanism 162. The actions (clamping and unclamping of the film F) of the first clamp 163 and the second clamp 164 are controlled by activating and stopping the activation of a first clamp drive mechanism 163*a* and a second clamp drive mechanism 164*a*, respectively. The first clamp drive mechanism 163*a* and the second clamp drive mechanism 164*a* can be mechanisms that utilize air pressure as a drive source or can be mechanisms that utilize motors as a drive source.

(2-2-9-3) Knife

The knife 166 is a member that cuts unneeded film F after the trailing end portion of the film F of the used film roll FR and the leading end portion of the film F of the replacement film roll FR have been spliced together by the splicing mechanism 162. Execution of the cutting by the knife 166 and stopping of the cutting by the knife 66 are controlled by activating and stopping a knife drive mechanism 166*a*. The knife drive mechanism 166*a* can be a mechanism that utilizes air pressure as a drive source or can be a mechanism that utilizes a motor as a drive source.

The film supply unit 100 has a knife activation detection sensor 166*b* for detecting that the knife 166 has been activated (in this embodiment, that the knife 166 has been driven downward to cut the film F) (see FIG. 3). The knife activation detection sensor 166*b* can be disposed on the same side as the knife 166 (in this embodiment, the upper side where the film splicing mechanism 160 and the like are disposed) or can be disposed on the first guide member 119 side.

The knife activation detection sensor 166*b* is, for example, a photoelectric sensor. However, as for the type of the knife activation detection sensor 166*b*, it suffices for the sensor to be capable of detecting the movement of the knife 166, and the sensor can also be an inductive or a capacitive proximity sensor, for example.

(2-2-9-4) Pinch Roller

The pinch roller 168 pinches the film F between itself and another fixed roller. By rotating the pinch roller 168, the film F is conveyed. The pinch roller 168 conveys the film F of the used film roll FR in a first direction D1 (see FIG. 9) so that the trailing end portion of the film F of the used film roll FR heads toward the film splicing position where splicing to the leading end portion of the film F of the new replacement film roll FR is performed by the splicing mechanism 162. The pinch roller 168 is a mechanism capable of changing the conveyance speed of the film F.

The pinch roller 168 will now be described in greater detail taking as an example the case shown in FIG. 9 where the second film roll FR2 is the used film roll FR and the first film roll FR1 is the new replacement film roll FR.

The pinch roller 168 is pushed, by a pinch roller air cylinder 168*a*, against a fixed roller 112 of the first holding mechanism 110*a* (in FIG. 9, a fixed roller 112*b* disposed uppermost out of the three fixed rollers 112) at the timing when positional adjustment of the trailing end portion of the film F of the used film roll FR (here, the trailing end portion F2T of the second film F2 of the second film roll FR2) is performed. As a result, the second film F2 is pinched between the pinch roller 168 and the fixed roller 112*b*. In this state, the pinch roller 168 is rotated clockwise (see the arrow in FIG. 9) as seen in a right side view by a pinch roller drive mechanism 168*b*. The pinch roller drive mechanism 168*b* is, for example, a servo motor. When the pinch roller 168 is rotated by the pinch roller drive mechanism 168*b*, the second film F2 is conveyed in the first direction D1 toward the second film roll FR2 (in the opposite direction of the direction in which the second film F2 is conveyed at the time of the bag-making and packaging actions). The pinch roller 168 conveys the second film F2 of the second film roll FR2 in the first direction D1 until the trailing end portion F2T of the second film F2 of the second film roll FR2 reaches the film splicing position where splicing to the leading end portion F1L of the first film F1 of the first film roll FR1 is performed by the splicing mechanism 162. Control of the driving of the pinch roller 168 by the pinch roller drive mechanism 168*b* will be described later.

(2-2-9-5) Trailing End Portion Position Adjustment Sensors

The trailing end portion position adjustment first sensor 152 and the trailing end portion position adjustment second sensor 154 are sensors that detect, in a state in which the film F is being conveyed, the register marks M for position adjustment added to the film F of the used film roll FR.

The trailing end portion position adjustment first sensor 152 and the trailing end portion position adjustment second sensor 154 are disposed along the path on which the film F is conveyed by the pinch roller 168. In particular, the trailing end portion position adjustment first sensor 152 and the trailing end portion position adjustment second sensor 154 are disposed along the conveyance path of the film F on the side of the printed surface Fa of the film F conveyed by the pinch roller 168. The trailing end portion position adjustment second sensor 154 detects, on the downstream side of the trailing end portion position adjustment first sensor 152 in the direction in which the film F is conveyed by the pinch roller 168 (the first direction D1), the register marks M for position adjustment added to the film F.

It is preferred that, when seen along the path on which the film F is conveyed by the pinch roller 168, the distance between the position where the trailing end portion position adjustment first sensor 152 detects the register marks M added to the film F and the position where the trailing end portion position adjustment second sensor 154 detects the register marks M added to the film F is between 10 mm and 90 mm.

The trailing end portion position adjustment first sensor 152 and the trailing end portion position adjustment second sensor 154 are, for example, register mark sensors. However, the type of the trailing end portion position adjustment first sensor 152 and the trailing end portion position adjustment second sensor 154 is not limited to register mark sensors and, for example, can be sensors utilizing cameras. For example, the trailing end portion position adjustment first sensor and the trailing end portion position adjustment second sensor can use cameras to image the printed surface Fa of the film F that is conveyed and detect, as marks for positional adjustment, the register marks M or the printing P on the printed surface Fa of the film F.

Control of the driving of the pinch roller 168 by the pinch roller drive mechanism 168*b* utilizing the trailing end portion position adjustment first sensor and the trailing end portion position adjustment second sensor will be described later.

(2-2-9-6) Cooling Air Electromagnetic Valve

The cooling air electromagnetic valve 161*a* is an electromagnetic valve for controlling the execution and stopping of the blowing-out of air from an air outlet 161 formed in the neighborhood of the splicing mechanism 162. The air blown out from the air outlet 161 cools the part of the film F spliced by the splicing mechanism 162.

(2-3) Controller

The controller 300 controls the actions of each part of the bag-making and packaging machine 1000 (the various configurations of the bag-making and packaging unit 200 and the film supply unit 100).

The controller 300 has a microcomputer that has parts such as a CPU and a memory. The controller 300 controls the actions of each part of the bag-making and packaging machine 1000 as a result of the CPU reading and executing programs stored in the memory.

As regards the controller, the same functions as the functions that the controller 300 of this embodiment exhibits can be realized by hardware such as a logic circuit or can be realized by a combination of hardware and software.

The controller 300 is electrically connected to each part of the bag-making and packaging machine 1000, such as, for example, the film conveyor belts 220, the longitudinal sealing mechanism 230, and the transverse sealing mechanism 240 of the bag-making and packaging unit 200. Furthermore, the controller 300 is electrically connected to the frame rotation motor 138, the first holding mechanism motor 114*a*, the second holding mechanism motor 114*b*, the air cylinder 118*a*, the leading end portion position adjustment sensor 142, the terminal end position adjustment air electromagnetic valve 146*a*, the splicing mechanism 162, the first clamp drive mechanism 163*a*, the second clamp drive mechanism 164*a*, the knife drive mechanism 166*a*, the knife activation detection sensor 166*b*, the pinch roller air cylinder 168*a*, the pinch roller drive mechanism 168*b*, the trailing end portion position adjustment first sensor 152, the trailing end portion position adjustment second sensor 154, the cooling air electromagnetic valve 161*a*, the movable roller mechanism air cylinder 187, and the encoder 188 of the film supply unit 100.

The controller 300 receives the detection results of the leading end portion position adjustment sensor 142, the trailing end portion position adjustment first sensor 152, and the trailing end portion position adjustment second sensor 154. The controller 300 also receives the detection result of the encoder 188 (the angle of rotation of the shaft 184*a* connected to the arms 186 to which the movable rollers 185 are secured). The detection result of the encoder 188 is used in the control of the position of the movable rollers 185. The detection result of the encoder 188 can also be used in the detection of the trailing end of the film roll FR described later.

(3) Control of Actions of Bag-Making and Packaging Machine 1000 by Controller (3-1) Normal Operation The controller 300 controls as follows the actions of each part of the bag-making and packaging machine 1000—for example, the holding mechanism motors 114*a*, 114*b* of the film drawing mechanism 116, the movable roller mechanism air cylinder 187, the film conveyor belts 220, the longitudinal sealing mechanism 230, and the transverse sealing mechanism 240—during normal operation in which the bag-making and packaging unit 200 performs the bag-making and packaging actions.

The controller 300 controls the film conveyor belts 220 so that the sheet-like film F pulled out from the film roll FR is conveyed at a predetermined speed (a speed decided from, for example, the operating load of the bag-making and packaging machine 1000) using the holding mechanism motors 114*a*, 114*b* of the film drawing mechanism 116. The operating modes of the bag-making and packaging machine 1000 include a continuous operating mode, in which the bag-making and packaging machine 1000 continuously conveys the film F (the tubular film Ft) at a constant speed, and an intermittent operating mode, in which the bag-making and packaging machine 1000 alternates between conveying and stopping the film F (the tubular film Ft). The operating mode of the bag-making and packaging machine 1000 is appropriately selected in accordance with operating conditions.

The controller 300 controls the starting and stopping of the holding mechanism motors 114*a*, 114*b* of the film drawing mechanism 116 and the speed at which the film roll FR is rotated by the holding mechanism motors 114*a*, 114*b* of the film drawing mechanism 116 on the basis of the state of conveyance of the film F and the detection result of the encoder 188. That is, the controller 300 controls the film drawing mechanism 116 to change the drawing speed of the film F at the time of the bag-making and packaging actions in the bag-making and packaging unit 200.

For example, the controller 300 starts and stops the holding mechanism motors 114*a*, 114*b* of the film drawing mechanism 116 drawing the film F in accordance with the timing when the controller 300 causes the film conveyor belts 220 to operate and stop. In other words, the controller 300 changes the speed at which the film F is drawn by the holding mechanism motors 114*a*, 114*b* of the film drawing mechanism 116 on the basis of the conveyance speed of the film conveyor belts 220 at the time of the bag-making and packaging actions in the bag-making and packaging unit 200.

Furthermore, the controller 300 controls the speed at which the shafts 111*a*, 111*b* holding the film roll FR are rotated by the holding mechanism motors 114*a*, 114*b* of the film drawing mechanism 116 on the basis of the detection result of the encoder 188. In other words, the controller 300 changes the speed at which the film F is drawn by the holding mechanism motors 114*a*, 114*b* of the film drawing mechanism 116 on the basis of the detection result of the encoder 188, namely, the position of the movable rollers 185, at the time of the bag-making and packaging actions in the bag-making and packaging unit 200.

Furthermore, the controller 300 controls the movable roller mechanism air cylinder 187 so that the movable rollers 185 cause constant force to act on the film F that is being conveyed.

Furthermore, the controller 300 controls the actions of the longitudinal sealing mechanism 230 and the transverse sealing mechanism 240 so that the longitudinal sealing mechanism 230 performs longitudinal sealing of the tubular film Ft at a predetermined timing and the transverse sealing mechanism 240 performs transverse sealing of the tubular film Ft at a predetermined timing.

(3-2) Action of Automatic Seaming of Film Rolls

Actions relating to automatic seaming (automatic splicing) of the film rolls FR of the bag-making and packaging machine 1000 will be described below.

(3-2-1) Action of Setting Replacement Film Roll

The work of the operator and the actions of the bag-making and packaging machine 1000 when setting the replacement film roll FR in the holding mechanisms 110*a*, 110*b* will now be described.

Here, the work of the operator and the actions of the bag-making and packaging machine 1000 when setting the first film roll FR1 in the first holding mechanism 110*a* will be described as an example. Actions when setting the second film roll FR2 in the second holding mechanism 110*b* are the same as actions when setting the first film roll FR1 in the first holding mechanism 110*a*, so here description thereof will be omitted.

First, the operator attaches the first film roll FR1 to the first shaft 111*a* of the first holding mechanism 110*a* disposed in the film roll setting position A1. Next, the operator pulls out the first film F1 from the first film roll FR1, puts the first film F1 along the upper surface of the first guide member 119, and then guides the first film F1 so that the first film F1 passes between the fixed rollers 112 and the movable roller 118 of the first film restraining mechanism 117. The operator then manually temporarily places, on the temporary placement surface 143*a* of the film temporary placement member 143, the neighborhood of the leading end portion of the film F pulled out from the film roll FR. Preferably, the operator temporarily places the first film F1 on the temporary placement surface 143*a* of the film temporary placement member 143 so that the register mark M printed on the printed surface F1*a* of the first film F1 and located in the neighborhood of the terminal end F1E of the first film F1 is disposed in the predetermined position range of the film temporary placement member 143. Next, the operator operates the temporary restraining mechanism 144 to temporarily restrain the first film F1 that has been temporarily placed on the temporary placement surface 143*a* of the film temporary placement member 143. Thereafter, the operator operates switches 102 provided on the back surface side of the film supply unit 100 to instruct the controller 300 to align the leading end portion F1L of the first film F1.

If the operator presses a switch 102 in a state in which the first film F1 has not been properly set in the first holding mechanism 110*a* (e.g., a state in which the first film roll FR1 has not been attached to the first shaft 111*a*), this can be detected by a change in the torque of the first holding mechanism motor 114*a* that is a servo motor. That is, in this bag-making and packaging machine 1000, it is possible to detect, without providing a separate sensor, that the first film F1 has not been properly set in the first holding mechanism 110*a*.

The controller 300 activates the connection mechanism 111*a*1 of the first shaft 111*a* in response to the instruction to align the leading end portion F1L of the first film F1, thereby connecting and securing the first film roll FR1 to the first shaft 111*a*. Furthermore, the controller 300 drives the air cylinder 118*a* to push the movable roller 118 against the fixed rollers 112 (in particular, the fixed roller 112*a* in the middle), sandwich the first film F1 between the movable roller 118 and the fixed rollers 112, and restrain the first film F1. As a result, misalignment of the first film F1 is reduced. Yet even in a state in which the movable roller 118 is restraining the first film F1, conveyance of the first film F1 by the first holding mechanism motor 114*a* is possible. Next, the controller 300 rotates the first holding mechanism motor 114*a* of the film drawing mechanism 116 to thereby rotate the first shaft 111*a* counter-clockwise as seen in a right side view. As a result, the first film F1 is taken up on the first film roll FR1 and the terminal end F1E of the first film F1 is conveyed to the leading end portion position adjustment sensor 142. The controller 300 stops the conveyance of the first film F1 by the first holding mechanism motor 114*a* when the leading end portion position adjustment sensor 142 detects the register mark M added to the first film F1 that is conveyed (the register mark M printed on the printed surface F1*a* of the first film F1 and located in the neighborhood of the terminal end RE of the first film F1). In this state, the leading end portion F1L of the first film F1 is disposed in the prescribed position. Misalignment of the first film F1 after the leading end portion F1L of the first film F1 has been positionally adjusted to the prescribed position is reduced as a result of the first film F1 being restrained by the movable roller 118. Summarizing the above, after the neighborhood of the leading end portion F1L of the first film F1 has been temporarily placed on the film temporary placement member 143, the controller 300 causes the first holding mechanism motor 114*a* to rotate the first film roll FR1 to thereby convey the first film F1 along a predetermined conveyance path. The controller 300 conveys the first film F1 along the predetermined conveyance path until the leading end portion position adjustment sensor 142 detects that the leading end portion F1L of the first film F1 is positioned in the prescribed position.

The controller 300 then ends the alignment of the leading end portion F1L of the first film F1.

Next, the moving mechanism 139 moves the first holding mechanism 110*a* from the film roll setting position A1 to the film roll standby position A3 before the leading end portion F1L of the first film F1 of the first film roll FR1 attached to the first shaft 111*a* of the first holding mechanism 110*a* is connected by the splicing mechanism 162 to the trailing end portion F2T of the second film F2 of the second film roll FR2 attached to the second shaft 111*b* of the second holding mechanism 110*b*. The film roll standby position A3 is a position rotated by the predetermined angle around the frame shaft 130 from the film roll setting position A1. In other words, the controller 300 controls the moving mechanism 139 (controls the frame rotation motor 138) to rotate the holding mechanism support frame 120 by the predetermined angle and move the first holding mechanism 110*a* from the film roll setting position A1 to the film roll standby position A3 so that the leading end portion F1L of the first film F1 is disposed in the place where it is spliced by the splicing mechanism 162. The first holding mechanism 110*a* that has been moved to the film roll standby position A3 stands by in that location, without particularly performing any action, until the trailing end of the second film F2 of the second film roll FR2 of the second holding mechanism 110*b* is detected.

When the first holding mechanism 110*a* is moved by the moving mechanism 139 from the film roll setting position A1 to the film roll standby position A3, the second holding mechanism 110*b* moves from the film supply position A2 to the film supply position A4. The controller 300 detects, by a change in position of the movable rollers 185 detected by the encoder 188 for example, problems caused by the movement of the second holding mechanism 110*b* to the film supply position A4, such as slackness in the second film F2 and deviation in the tension acting on the second film F2 from its proper value, and, on the basis of the detection result, controls the second holding mechanism motor 114*b* of the film drawing mechanism 116 and so forth to eliminate the detected problem.

It is preferred that when the controller 300 moves the first holding mechanism 110*a* from the film roll setting position A1 to the film roll standby position A3, the controller 300 perform positional adjustment of the neighborhood of the terminal end F1E of the first film F1 by controlling the terminal end position adjustment air electromagnetic valve 146*a* to blow air from the terminal end position adjustment air nozzle 146 onto the neighborhood of the terminal end F1E on the leading end portion F1L side of the first film F1. The positional adjustment of the neighborhood of the terminal end FILE of the first film F1 is as described above.

Furthermore, when the first holding mechanism 110*a* is rotated by the predetermined angle around the frame shaft 130 from the film roll setting position A1 and moved to the film roll standby position A3 by the moving mechanism 139, the film drawing mechanism 116 rotates the first shaft 111*a* of the first holding mechanism 110*a* by an angle according to the predetermined angle (e.g., the same angle as the predetermined angle) in the same direction as the rotational direction of the first holding mechanism 110*a*. Due to this kind of control, slackness in the first film F1 arising during the rotation of the first holding mechanism 110*a* and caused as a result of the first shaft 111*a* and the second layer shaft 134 of the frame shaft 130 being interconnected via the belt 115*b*1 of the second transmission mechanism 115*b* can be reduced. Because such slackness in the first film F1 is reduced, for example, the occurrence of problems such as a shift in the position of the leading end portion F1L of the first film F1 can be reduced.

(3-2-2) Actions Relating to Automatic Seaming of Trailing End Portion of Film of Used Film Roll and Leading End Portion of Film of Replacement Film Roll Actions of the bag-making and packaging machine 1000 relating to the automatic seaming of the film rolls FR will now be described. Here, description will be given taking as an example a case where the second film roll FR2 is the used film roll (the film roll that was used for bag-making and packaging) and the first film roll FR1 is the replacement film roll. Actions when the film F of the used film roll FR is spliced to the film F of the replacement film roll FR are the same in both a case where the first film roll FR1 is the used film roll and the second film roll FR2 is the replacement film roll and a case where the second film roll FR2 is the used film roll and the first film roll FR1 is the replacement film roll. Thus, here, for the sake of simplifying the specification, description in regard to a case where the first film roll FR1 is the used film roll and the second film roll FR2 is the replacement film roll will be omitted.

The automatic seaming of the film rolls FR is performed using as a trigger the detection the trailing end of the film roll FR that is in use.

The controller 300 detects the trailing end of the second film roll FR2 on the basis of the detection result of the encoder 188, for example. The controller 300 detects the trailing end of the second film roll FR2 on the basis of a physical quantity relating to the position of the movable rollers 185 that the encoder 188 detects, specifically, the angle of rotation of the shaft 184*a* to which are connected the arms 186 to which the movable rollers 185 are secured.

During the normal operation of the bag-making and packaging machine 1000, the position of the movable rollers 185 is controlled to a predetermined position (a predetermined region). However, once the trailing end of the film roll FR is reached, the film F cannot be pulled out any further from the film roll FR, so even if the controller 300 controls the actions of each part of the bag-making and packaging machine 1000, the movable rollers 185 are lifted up by the film F and move upward beyond the predetermined region. Thus, the controller 300 determines whether or not the angle of rotation of the shaft 184*a* that the encoder 188 detects has exceeded a predetermined threshold value (whether or not the arms 186 have rotated to a position they cannot take during normal operation). In a case where the angle of rotation of the shaft 184*a* has exceeded the predetermined threshold value, the controller 300 detects the trailing end of the film roll FR.

In this embodiment, the trailing end of the film roll FR is detected using the encoder 188 as a sensor, but the method of detecting the trailing end of the film roll FR is not limited to this. For example, in another configuration, a photoelectric sensor 190 (see FIG. 2) disposed in the neighborhood of the film supply positions A2, A4 can detect the trailing end of the film roll FR by detecting an end mark (not shown in the drawings) added to the film F and indicating the trailing end of the film roll FR (in FIG. 4, the photoelectric sensor 190 is omitted). Furthermore, for example, the trailing end of the film roll FR can be detected by detecting the film F using a camera or a sensor (not shown in the drawings) disposed in the neighborhood of the film supply positions A2, A4.

The controller 300 stops the actions of the film conveyor belts 220, the longitudinal sealing mechanism 230, and the transverse sealing mechanism 240 when the sensor such as the encoder 188 or the photoelectric sensor 190 has detected the trailing end of the film roll FR. Furthermore, the controller 300 stops the actions of the second holding mechanism motor 114*b* of the film drawing mechanism 116 when the sensor such as the encoder 188 or the photoelectric sensor 190 has detected the trailing end of the film roll FR.

Furthermore, when the sensor such as the encoder 188 or the photoelectric sensor 190 has detected the trailing end of the film roll FR, the controller 300 drives the pinch roller air cylinder 168*a* to push the pinch roller 168 against one of the fixed rollers 112 (the fixed roller 112*b*) of the first holding mechanism 110*a* to thereby sandwich and hold the second film F2 between the pinch roller 168 and the fixed roller 112*b*. Moreover, the controller 300 drives the pinch roller drive mechanism 168*b* clockwise as in FIG. 9 as seen in a right side view to start conveyance of the second film F2 in the first direction D1 (the opposite direction of the conveyance direction of the film F during normal operation). The fixed roller 112*c* disposed lowermost and frontmost in the state shown in FIG. 9 out of the fixed rollers 112 of the first holding mechanism 110*a* is utilized as a guide during the conveyance of the second film F2 by the pinch roller 168.

At this time, the controller 300 controls the pinch roller drive mechanism 168*b* to convey the second film F2 at a conveyance speed V1 in the first direction D1 until the trailing end portion position adjustment first sensor 152 detects the register mark M printed on the printed surface F2*a* of the second film F2. After the trailing end portion position adjustment first sensor 152 has detected the register mark M, the controller 300 conveys the second film F2 at a conveyance speed V2 in the first direction D1. Then, when the trailing end portion position adjustment second sensor 154 detects the register mark M, the controller 300 judges that the trailing end portion F2T of the second film F2 has reached the film splicing position where splicing is performed by the splicing mechanism 162. Then, the controller 300 performs control that stops the pinch roller drive mechanism 168*b* to stop the conveyance of the second film F2 by the pinch roller 168. The conveyance speed V1 and the conveyance speed V2 have the relationship of conveyance speed V1>conveyance speed V2. For example, although they are not limited, the conveyance speed V1 is a speed twice or more the conveyance speed V2. That is, in this embodiment, the controller 300 controls the pinch roller 168

(more specifically, the pinch roller drive mechanism 168*b*) in such a way that the speed V1 at which the second film F2 is conveyed by the pinch roller 168 before the trailing end portion position adjustment first sensor 152 detects the register mark M is faster than the speed V2 at which the second film F2 is conveyed by the pinch roller 168 after the detection of the register mark M by the trailing end portion position adjustment first sensor 152.

The trailing end portion position adjustment second sensor 154 detects the register mark M printed on the printed surface F2*a* of the second film F2, and when the conveyance of the second film F2 by the pinch roller 168 has been stopped on the basis of this, the trailing end portion F2T of the second film F2 has been moved to the position where it is spliced by the splicing mechanism 162. In this state, the controller 300 drives the first clamp drive mechanism 163*a* and the second clamp drive mechanism 164*a* to restrain the second film F2 with the first clamp 163 and the second clamp 164 in order to reduce misalignment of the trailing end portion F2T of the second film F2. Furthermore, the controller 300 controls the splicing mechanism 162 to splice together the trailing end portion F2T of the second film F2 and the leading end portion F1L of the first film F1. For example, the controller 300 executes, at generally the same timing, the driving of the first clamp drive mechanism 163*a* and the second clamp drive mechanism 164*a* and the splicing together of the trailing end portion F2T of the second film F2 and the leading end portion F1L of the first film F1 by the splicing mechanism 162. Next, the controller 300 drives the knife drive mechanism 166*a* to cut the film F with the knife 166 in order to cut away unnecessary first film F1 and second film F2 from the film F used in normal operation.

Next, in preparation for normal operation, the controller 300 controls the second clamp drive mechanism 164*a* to release the restraint of the second film F2 by the second clamp 164. Furthermore, the controller 300 controls the cooling air electromagnetic valve 161*a* to blow out air from the air outlet 161 onto the place where the first film F1 and the second film F2 have been spliced together. Moreover, the controller 300 controls the first clamp drive mechanism 163*a* to release the restraint of the film F by the first clamp 163. Furthermore, the controller 300 controls the pinch roller air cylinder 168*a* to move the pinch roller 168 away from the fixed roller 112*b* and release the restraint of the film F by the pinch roller 168.

Thereafter, the controller 300 causes the moving mechanism 139 to move the first holding mechanism 110*a* positioned in the film roll standby position A3 to the film supply position A2 and activates the film conveyor belts 220, the longitudinal sealing mechanism 230, and the transverse sealing mechanism 240 to return to normal operation. When the first holding mechanism 110*a* is moved to the film supply position A2, the second holding mechanism 110*b* moves to the film roll setting position A1. Then, a new (replacement) second film roll FR2 can be set in the second holding mechanism 110*b*.

(4) Characteristics (4-1)

The bag-making and packaging machine 1000 of the above embodiment has the bag-making and packaging unit 200 and the film supply unit 100. The bag-making and packaging unit 200 forms the sheet-like film F into a tubular shape and seals the film Ft that has been formed into the tubular shape to thereby form the film Ft into bags. The film supply unit 100 holds the film rolls FR into which the sheet-like film F is wound and supplies to the bag-making and packaging unit 200 the film F that is drawn from the film rolls FR. The film supply unit 100 has the first holding mechanism 110*a* and the second holding mechanism 110*b* that serve as an example of plural film roll holding mechanisms, the holding mechanism support frame 120 that serves as an example of a frame, the frame shaft 130, the moving mechanism 139, the splicing mechanism 162, and the film drawing mechanism 116. The first holding mechanism 110*a* includes the first shaft 111*a* to which the film roll FR is attached and which rotatably holds the attached film roll FR. The second holding mechanism 110*b* includes the second shaft 111*b* to which the film roll FR is attached and which rotatably holds the attached film roll FR. The holding mechanism support frame 120 supports the first holding mechanism 110*a* and the second holding mechanism 110*b*. The frame shaft 130 rotatably supports the holding mechanism support frame 120. The moving mechanism 139 rotates the holding mechanism support frame 120 to thereby move the first holding mechanism 110*a* and the second holding mechanism 110*b* between at least the film roll setting position A1 and the film supply position A2 that is different from the film roll setting position A1. The film roll setting position A1 is an example of a first position. The film supply position A2 is an example of a second position. In the film roll setting position A1, the film rolls FR is attached to the shaft 111*a*, 111*b*. In the film supply position A2, the film F is drawn from the film rolls FR attached to the shafts 111*a*, 111*b* to the bag-making and packaging unit 200. The splicing mechanism 162 splices together the trailing end portion of the film F wound into the film roll FR attached to the shaft 111*a*, 111*b* of one of the holding mechanisms 110*a*, 110*b* and the leading end portion of the film F wound into the film roll FR attached to the shaft 111*b*, 111*a* of the other one of the holding mechanisms 110*b*, 110*a*. For example, referring to FIG. 9, the splicing mechanism 162 splices together the trailing end portion F2T of the second film F2 wound into the second film roll FR2 attached to the second shaft 111*b* of the second holding mechanism 110*b* and the leading end portion F1L of the first film F1 wound into the first film roll FR1 attached to the first shaft 111*a* of the first holding mechanism 110*a*. The film drawing mechanism 116 respectively independently rotates the shafts 111*a*, 111*b* of the plural holding mechanisms 110*a*, 110*b* to draw the film F from the film rolls FR attached to the shafts 111*a*, 111*b* of the plural holding mechanisms 110*a*, 110*b*. The film drawing mechanism 116 changes the drawing speed of the film F at the time of the bag-making and packaging actions in the bag-making and packaging unit 200.

In the bag-making and packaging machine 1000 of this embodiment, the film rolls FR are attached to the shafts in the same film roll setting position A1 and are moved by the moving mechanism 139 to other positions. For that reason, the workload of the operator of the bag-making and packaging machine 1000 can be reduced.

Furthermore, in this bag-making and packaging machine 1000, the drawing speed of the film rolls FR at the time of the bag-making and packaging actions can be changed, so an efficient bag-making and packaging machine can be realized.

(4-2)

In the bag-making and packaging machine 1000 of this embodiment, the frame shaft 130 includes a multilayer shaft structure. The moving mechanism 139 includes the frame rotation motor 138 that serves as an example of a first motor and the frame rotation transmission mechanism 137 that serves as an example of a first transmission mechanism. The frame rotation motor 138 rotates the holding mechanism support frame 120. The frame rotation transmission mechanism 137 transmits the driving force of the frame rotation motor 138 to the first layer shaft 132 that serves as an example of a first layer shaft of the frame shaft 130.

The film drawing mechanism 116 includes the first holding mechanism motor 114*a* that serves as an example of a second motor, the first transmission mechanism 115*a* that serves as an example of a second transmission mechanism, and the second transmission mechanism 115*b* that serves as an example of a third transmission mechanism. The first holding mechanism motor 114*a* rotates the first shaft 111*a* of the first holding mechanism 110*a* among the plural holding mechanisms 110*a*, 110*b*. The first transmission mechanism 115*a* transmits the driving force of the first holding mechanism motor 114*a* to the second layer shaft 134 that serves as an example of a second layer shaft of the frame shaft 130. The second transmission mechanism 115*b* transmits the driving force that has been transmitted to the second layer shaft 134 of the frame shaft 130 to the first shaft 111*a* of the first holding mechanism 110*a* that is the drive target of the first holding mechanism motor 114*a*.

Furthermore, the film drawing mechanism 116 includes the second holding mechanism motor 114*b* that serves as an example of a second motor, the third transmission mechanism 115*c* that serves as an example of a second transmission mechanism, and the fourth transmission mechanism 115*d* that serves as an example of a third transmission mechanism. The second holding mechanism motor 114*b* rotates the second shaft 111*b* of the second holding mechanism 110*b* among the plural holding mechanisms 110*a*, 110*b*. The third transmission mechanism 115*c* transmits the driving force of the second holding mechanism motor 114*b* to the third layer shaft 136 that serves as an example of a second layer shaft of the frame shaft 130. The fourth transmission mechanism 115*d* transmits the driving force that has been transmitted to the third layer shaft 136 of the frame shaft 130 to the second shaft 111*b* of the second holding mechanism 110*b* that is the drive target of the second holding mechanism motor 114*b*.

In this bag-making and packaging machine 1000, a multilayer shaft structure is employed for the frame shaft 130 whose position is not changed by the rotation of the holding mechanism support frame 120, and the driving force of the holding mechanism motors 114*a*, 114*b* is configured to be transmitted via the frame shaft 130 to the shafts 111*a*, 111*b* of the holding mechanisms 110*a*, 110*b*. For that reason, the holding mechanism motors 114*a*, 114*b* that drive the shafts 111*a*, 111*b* do not need to be moved when the holding mechanisms 110*a*, 110*b* are moved. For that reason, attachment of the film rolls FR at the same position can be realized with a simple structure.

(4-3)

In the bag-making and packaging machine 1000 of this embodiment, the film supply unit 100 has the movable rollers 185 that are disposed on the conveyance path of the film F drawn from the film rolls FR and cause tension to act on the film F. The film drawing mechanism 116 changes the drawing speed of the film F on the basis of the position of the movable rollers 185 at the time of the bag-making and packaging actions in the bag-making and packaging unit 200.

In this bag-making and packaging machine 1000, the drawing speed of the film F is adjusted in accordance with the position of the movable rollers 185, so high-speed bag-making can be realized.

(4-4)

In the bag-making and packaging machine 1000 of this embodiment, the bag-making and packaging unit 200 has the film conveyor belts 220 that serve as an example of a film conveyance mechanism that conveys the film F. The film drawing mechanism 116 changes the drawing speed of the film F on the basis of the speed at which the film F is conveyed by the film conveyor belts 220 at the time of the bag-making and packaging actions in the bag-making and packaging unit 200.

For example, when the film conveyor belts 220 intermittently convey the film F, the film drawing mechanism 116 changes the drawing speed of the film F in accordance with the acceleration and deceleration in the speed at which the film F is conveyed by the film conveyor belts 220.

In this bag-making and packaging machine 1000, the speed at which the film F is drawn from the film rolls FR is appropriately adjusted in accordance with the speed at which the film F is conveyed by the film conveyor belts 220 in the bag-making and packaging unit 200, so high-speed bag-making can be realized.

(4-5)

In the bag-making and packaging machine 1000 of this embodiment, before the leading end portion of the film F of the film roll FR attached to the shaft 111*a*, 111*b* of one of the holding mechanisms 110*a*, 110*b* is connected by the splicing mechanism 139 to the trailing end portion of the film F of the film roll FR attached to the shaft 111*b*, 111*a* of the other of the holding mechanisms 110*b*, 110*a*, the moving mechanism 139 moves the one holding mechanism 110*a*, 110*b* to the film roll standby position A3 rotated by the predetermined angle around the frame shaft 130 from the film roll setting position A1. When the moving mechanism 139 moves the one of the holding mechanism 110*a*, 110*b* from the film roll setting position A1 to the film roll standby position A3, the film roll drawing mechanism 116 rotates the shaft 111*a*, 111*b* of the holding mechanism 110*a*, 110*b* by an angle according to the predetermined angle (an angle in which slackness does not arise in the film F) in the same direction as the rotational direction of the one of holding mechanism 110*a*, 110*b*. For example, when the moving mechanism 139 moves the one of the holding mechanism 110*a*, 110*b* from the film roll setting position A1 to the film roll standby position A3, the film drawing mechanism 116 rotates the shaft 111*a*, 111*b* of the holding mechanism 110*a*, 110*b* by the same angle as the predetermined angle in the same direction as the rotational direction of the one of holding mechanism 110*a*, 110*b*.

In this bag-making and packaging machine 1000, when the one holding mechanism 110*a*, 110*b* holding the replacement film roll FR is rotated by the predetermined angle from the film roll setting position A1 to the film roll standby position A3 to splice the film F, the shaft 111*a*, 111*b* thereof is rotated by an angle according to the predetermined angle in the same direction as the direction in which the holding mechanism 110*a*, 110*b* is rotated by the moving mechanism 139. For that reason, slackness in the film F arising because of the rotation of the holding mechanism 110*a*, 110*b* can be eliminated so that the occurrence of misalignment of the film F and/or conveyance problems caused by the slackness in the film F can be reduced.

(5) Example Modifications

Example modifications of the embodiment will be described below. The example modifications can be appropriately combined to the extent that they are not mutually incompatible.

(5-1) Example Modification A

In the above embodiment, the alignment of the leading end portion of the film of the replacement film roll is performed automatically by the bag-making and packaging machine 1000, but the alignment of the leading end portion of the film of the replacement film roll is not limited to this and can be performed manually.

(5-2) Example Modification B

In the above embodiment, the alignment of the trailing end portion of the film of the used film roll is performed using two trailing end portion position adjustment sensors, but the alignment of the trailing end portion of the film of the used film roll is not limited to this and can be performed using a single trailing end portion position adjustment sensor (without changing the speed at which the film F is conveyed in the first direction D1).

(5-3) Example Modification C

In the above embodiment, the bag-making and packaging machine 1000 has the two holding mechanisms 110*a*, 110*b*, but the bag-making and packaging machine 1000 is not limited to this and can also have three or more holding mechanisms.

(5-4) Example Modification D

The holding mechanism motors 114*a*, 114*b* that rotate the shafts 111*a*, 111*b* of the holding mechanisms 110*a*, 110*b* can be motors that directly rotate the shafts 111*a*, 111*b*. However, in a case where the holding mechanism motors 114*a*, 114*b* directly rotate the shafts 111*a*, 111*b*, it becomes necessary to move the holding mechanism motors 114*a*, 114*b* in accompaniment with moving the holding mechanisms 110*a*, 110*b*. Therefore, from the standpoint of simplifying wiring and assembly it is preferred that the holding mechanism motors 114*a*, 114*b* be configured as in the above embodiment.

The present invention can be widely applicable for bag-making and packaging machines and is useful.

REFERENCE SIGNS LIST

100 Film Supply Unit
110*a* First Holding Mechanism (Film Roll Holding Mechanism)
110*b* Second Holding Mechanism (Film Roll Holding Mechanism)
111*a* First Shaft (Shaft)
111*b* Second Shaft (Shaft)
114*a* First Holding Mechanism Motor (Second Motor)
114*b* Second Holding Mechanism Motor (Second Motor)
115*a* First Transmission Mechanism (Second Transmission Mechanism)
115*b* Second Transmission Mechanism (Third Transmission Mechanism)
115*c* Third Transmission Mechanism (Second Transmission Mechanism)
115*d* Fourth Transmission Mechanism (Third Transmission Mechanism)
116 Film Drawing Mechanism
120 Holding Mechanism Support Frame (Frame)
130 Frame Shaft
137 Frame Rotation Transmission Mechanism (First Transmission Mechanism)
138 Frame Rotation Motor (First Motor)
139 Moving Mechanism
162 Splicing Mechanism
185 Movable Rollers
200 Bag-making and Packaging Unit
220 Film Conveyor Belts (Film Conveyance Mechanism)
1000 Bag-making and Packaging Machine
A1 Film Roll Setting Position (First Position)
A2 Film Roll Supply Position (Second Position)
A3 Film Roll Standby Position (Third Position)
F Film
F1L Leading End Portion
F1E Terminal End
F2T Trailing End Portion
FR Film Roll

What is claimed is:

1. A bag-making and packaging machine comprising:

a bag-making and packaging unit configured to form a sheet-like film into a tubular shape and seal the film formed into the tubular shape to thereby form the film into bags; and a film supply unit configured to hold a film roll into which the sheet-like film is wound and supply to the bag-making and packaging unit the film drawn from the film roll, wherein the film supply unit includes a plurality of film roll holding mechanisms including a first film roll holding mechanism and a second film roll holding mechanism, each of the plurality of film roll holding mechanism including a shaft to which the film roll is attached and which rotatably holds the attached film roll, a frame that supports the plurality of film roll holding mechanisms, a frame shaft that rotatably supports the frame, a moving mechanism that rotates the frame to thereby move the film roll holding mechanisms between at least a first position where the film roll is attached to the shaft and a second position, different from the first position, where the film is drawn from the film roll attached to the shaft to the bag-making and packaging unit, a splicing mechanism that splices together a trailing end portion of the film wound into the film roll attached to the shaft of one of the film roll holding mechanisms and a leading end portion of the film wound into the film roll attached to the shaft of another one of the film roll holding mechanisms, and a film drawing mechanism that respectively independently rotates each of the shafts of the plurality of film roll holding mechanisms to thereby draw the film from the film roll attached to the shafts of the plurality of film roll holding mechanisms, the film drawing mechanism including a first holding mechanism motor configured to rotate the first film roll holding mechanism and a second holding mechanism motor configured to rotate the second film roll holding mechanism, and the film drawing mechanism changes a drawing speed of the film when a bag-making and packaging action is performed in the bag-making and packaging unit.

2. The bag-making and packaging machine according to claim 1, wherein the frame shaft includes a multilayer shaft structure, the moving mechanism includes a first motor that rotates the frame and a first transmission mechanism that transmits a driving force of the first motor to a first layer shaft of the frame shaft, and the film drawing mechanism includes a second transmission mechanism that transmits a driving force of the first holding mechanism motor to a second layer shaft of the frame shaft, and a third transmission mechanism that transmits the driving force transmitted to the second layer shaft of the frame shaft to the shaft of the first film roll holding mechanism.

3. The bag-making and packaging machine according to claim 1, wherein the film supply unit further includes a movable roller that is disposed on a conveyance path of the film drawn from the film roll and causes tension to act on the film, and the film drawing mechanism changes the drawing speed of the film based on a position of the movable roller when a bag-making and packaging action is performed in the bag-making and packaging unit.

4. The bag-making and packaging machine according to claim 1, wherein the bag-making and packaging unit includes a film conveyance mechanism that conveys the film, and the film drawing mechanism changes the drawing speed of the film based on a conveying speed at which the film is conveyed by the film conveyance mechanism when a bag-making and packaging action is performed in the bag-making and packaging unit.

5. The bag-making and packaging machine according to claim 1, wherein before the leading end portion of the film of the film roll attached to the shaft of the first film roll holding mechanism is connected by the splicing mechanism to the trailing end portion of the film of the film roll attached to the shaft of the second film roll holding mechanism, the moving mechanism moves the first film roll holding mechanism to a third position rotated by a predetermined angle around the frame shaft from the first position, and when the moving mechanism moves the first film roll holding mechanism from the first position to the third position, the film drawing mechanism rotates the shaft of the first film roll holding mechanism by an angle according to the predetermined angle in a same direction as a rotating direction in which the moving mechanism rotates the first film roll holding mechanism.

* * * * *